US005370982A

United States Patent [19]

Tashiro et al.

[11] Patent Number: 5,370,982

[45] Date of Patent: Dec. 6, 1994

[54] SILVER HALIDE COLOR PHOTOGRAPHIC LIGHT-SENSITIVE MATERIAL

[75] Inventors: Mamoru Tashiro; Hirokazu Kondo, both of Minami-Ashigara, Japan

[73] Assignee: Fuji Photo Film Co., Ltd., Kanagawa, Japan

[21] Appl. No.: 137,758

[22] Filed: Oct. 19, 1993

[30] Foreign Application Priority Data

Oct. 20, 1992 [JP] Japan ..... 4-306240

[51] Int. Cl.[5] ..... G03C 1/85

[52] U.S. Cl. ..... 430/529; 430/523; 430/533; 430/950; 430/527; 430/536; 430/628; 430/512

[58] Field of Search ..... 430/523, 529, 533, 950, 430/527, 536, 628, 512

[56] References Cited

U.S. PATENT DOCUMENTS

| | | | |
|---|---|---|---|
| 2,391,181 | 5/1944 | Minsk et al. | 430/536 |
| 2,992,101 | 7/1961 | Jelley et al. | 430/357 |
| 3,767,448 | 10/1973 | Hutton | 430/628 |
| 4,388,402 | 6/1983 | Mukunoki et al. | 430/536 |
| 5,238,800 | 8/1993 | Hosoi et al. | 430/527 |
| 5,254,448 | 10/1993 | Yamada et al. | 430/523 |

FOREIGN PATENT DOCUMENTS

| | | | |
|---|---|---|---|
| 3161742 | 7/1991 | Japan | 430/512 |
| 0125552 | 4/1992 | Japan | 430/512 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide color photographic light-sensitive material includes at least one light-sensitive silver halide emulsion layer and an outermost protective layer on a support. The protective layer contains an acid polymer having a carboxyl, phosphoric acid and/or sulfonic group, and a matting agent formed of particles of a copolymer of methyl methacrylate, ethyl acrylate and methacrylic acid having a specified molar ratio of the repeating units. Also, at least one protective layer contains an ultraviolet absorbent.

5 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material, and more specifically, to a light-sensitive material in which deterioration of the graininess caused by a matting agent is suppressed.

2. Description of the Related Art

A silver halide color photographic light-sensitive material generally has at least one silver halide emulsion layer on a support, and a surface layer, i.e. protective layer, formed thereon, using a hydrophillic colloide material, a typical example of which is gelatin, as a binder. With such a structure, the surface of the photographic light-sensitive material increases its adhesiveness or stickiness when preserved under a high-temperature and high-humidity atmosphere. As a result, the light-sensitive material tends to adhere by itself or to some other material. The adhesion phenomenon, which is an obstacle to the use of the light-sensitive material, occurs during the manufacture, preservation, photographing, processing, projecting, or preservation after processing, of the light-sensitive material.

For solving such a problem, there is a well-known method of reducing the adhesiveness of the light-sensitive material, wherein fine particles (matting agent) of an inorganic substance such as silica, titanium dioxide, magnesium oxide or magnesium carbonate, or of an organic substance such as polymethylmethacrylate or cellulose acetate propionate are added to the protective layer to increase the surface roughness, thereby matting the surface.

Color light-sensitive materials, in particular, contain a large amount of oily substances in their light-sensitive and non-light-sensitive layers, and therefore the adhesion phenomenon is more likely to occur. Thus, the color light-sensitive material requires addition of a larger amount of the matting agent.

However, the above-mentioned matting agent is insoluble in an alkaline developing solution, and remains in the light-sensitive material after the development. As a result, if the matting agent is used in a great amount, the transparency of the formed image is lowered, or the quality of image is degraded.

There is a technique employed in this field, for avoiding such a drawback, wherein used is a matting agent which is insoluble in a neutral or acidic solution, but soluble in an alkaline solution such as a color developing solution. Examples of such a matting agent include those consisting of a copolymer of methyl methacrylate (to be abbreviated as MMA hereinafter)/methacrylic acid (to be abbraviated as MAA hereinafter) at a mole ratio of 6/4 to 9/1, disclosed in JP-B-57-9054, a copolymer of ethyl methacrylate (to be abbreviated as EMA hereinafter)/MAA, disclosed in JP-A-58-66937, and a copolymer of MMA, EMA and MAA, disclosed in JP-A-60-126644.

Even if the above-mentioned alkali-soluble matting agent is used, however, the agent is not completely dissolved in a developing solution and remains in a deformed form, or even if completely dissolved, it leaves hole marks after the dissolution. As a result, when printing is carried out with the specular light or similar light, the image subsequently obtained has graininess deteriorated due to the hole marks. Therefore, it is not adequate that the amount of the matting agent is increased to solve a static fogging problem caused by the adhesion phenomenon. The degradation of graininess caused by the matting agent is a major problem particularly in a super-enlargement printing for a general color negative film, preparation of an intermediate film for a movie, or in projection using a positive film.

As a solution, an acid polymer may be used in order to prevent the degradation of graininess. However, it has been found that the addition of an acid polymer containing a carboxyl group, phosphoric acid group, or sulfonic acid group to the outermost protective layer degrades the anti-adhesion property, resulting in a tendency to generate static fogging.

In addition to matting the surface, there is known, as means for suppressing static fogging, to use an ultraviolet absorbent to absorb the generated static light, making it harmless. The inventors of the present invention have conducted a variety of comparison tests on matting agents and ultraviolet absorbents, and have come to a conclusion that it is more effective if the protective layer contains an ultraviolet absorbent to achieve the purpose of the present invention.

SUMMARY OF THE INVENTION

An object of the invention is to provide a silver halide color photographic light-sensitive material having a good graininess and little static fogging, wherein prevented is roughness of an image obtained when enlargement printing is carried out by means of specular light or light close to the specular light.

The above object of the invention can be achieved by a silver halide color photographic light-sensitive material comprising at least one light-sensitive silver halide emulsion layer containing a color coupler, and a protective layer comprising a non-light-sensitive hydrophillic colloid layer as the outermost layer, on a support, wherein the protective layer contains an acid polymer having at least one acidic group selected from a carboxyl group, a phosphoric acid group and a sulfonic acid group, and a matting agent comprising particles of a polymer represented by the following formula (1), and at least one protective layer contains an ultraviolet absorbent:

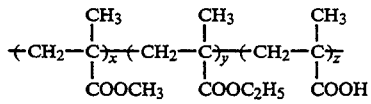

Formula (1)

where x, y, and z each represents a molar ratio, satisfying $3/7<(x+y)/z<7/3$.

DETAILED DESCRIPTION OF THE PREFERRED EMBODIMENTS

The present invention will now be described in detail.

The color photographic light-sensitive material of the present invention has a protective layer containing a certain acid polymer, a specified matting agent and an ultraviolet absorbent.

Techniques of using a polymer having an acid group or a salt thereof (to be abbreviated in some cases as acid polymer hereinafter) as a viscosity adjusting agent of a coating liquid, an antistatic agent, or an inhibitor of reticulation which may occur during a development process, are disclosed in, for example, JP-B-53-21646, JP-B-57-15375, JP-B-61-34656, JP-B-61-61096, and JP-A-3-119346. However, these techniques entirely differ from the present invention in construction as well as effect. More specifically, JP-B-53-21646 discloses that the outermost layer contains a polymer having a carboxyl group for the purpose of prevention of reticulation which may occur during a hot treatment, and the matting agent in the outermost layer consists of alkali-insoluble PMMA polymer particles, in which points, the technique of this document essentially differs from the present invention. JP-B-61-61096 discloses use of a copolymer of maleic acid and styrene, as a viscosity-adjusting agent for a coating liquid, but does not specify a layer which contains the agent, and an ultraviolet absorbent is not used at all. Therefore, the technique disclosed in this document differs from the present invention in construction and purpose. JP-B-57-15375, JP-B-61-34656, and the others are directed to methods of preventing static failure, and differ from the present invention in construction.

The protective layer of the present invention, which is a non-light-sensitive hydrophillic colloidal layer, may be of a single-layered structure or of a multi-layered structure including two or more sublayers. The multi-layered structure is preferable in terms of prevention of adhesion. In any case, the protective layer is located at the position furthest from the support of all the coated layers, and must include a matting agent comprising particles of a polymer represented by the formula (1).

The thickness of the outermost protective layer of the present invention is usually 0.2 to 3.0 μm, preferably 0.5 to 2.0 μm. The term "thickness" used here is meant to be the thickness of the portion in which no matting agents or polymer particles are present, and measured from an electron microscope photograph of a cross section of the light-sensitive material.

Acid polymers employed in the present invention will now be described.

In the present invention, the acid polymer may have any basic skeleton as long as the polymer contains at least one of a carboxyl group, a phosphoric acid group, and a sulfonic acid group. These acid groups improve compatibility or uniform miscibility of the polymer with a binder such as gelatin. The most simple polymer includes a homopolymer obtained by polymerizing acid residue-containing vinyl monomers having a carboxyl group, a phosphoric acid group, or a sulfonic acid group. Specific examples are polymers of acrylic acid, methacrylic acid, α-chloroacrylic acid, acrylamidoacetic acid, 3-acrylamidopropionic acid, 4-acrylamidobutyric acid, methacrylamidoacetic acid, 3-methacrylamidopropionic acid, itaconic acid, crotonic acid, 2-acrylamido-2-methylpropanesulfonic (AMPS), p-styrenesulfonic acid, 3-acrylamidopropanesulfonic acid, 3-acryloyloxypropanesulfontc acid, vinyl sulfonic acid, or a salt thereof, as well as polymers of the following monomers:

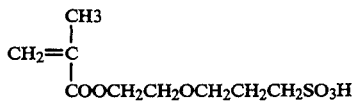

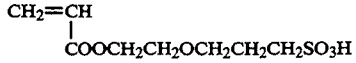

-continued

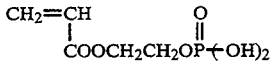

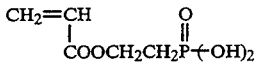

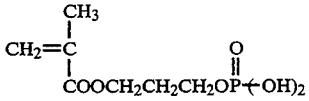

A copolymer of any two or more of the above monomers may be used.

Further, a copolymer of the above-mentioned acid residue-containing monomer or monomers with a monomer or monomers not containing the acid residue can be used in the present invention. The monomer having no acid residue includes acrylic esters, acrylamides, methacrylamides, vinylesters, vinylketones, allyl compounds, olefines, vinylethers, N-vinylethers, N-vinylamides, vinyl heterocyclic compounds, maleic esters, itaconic esters, fumaric esters, and crotonic esters.

Specific examples thereof are methyl acrylate, ethyl acrylate, n-propyl acrylate, n-butyl acrylate, sec-butyl acrylate, octyl acrylate, diethylglycol monoacrylate, trimethylolethane monoacrylate, 3-methoxybutyl acrylate, ω-methoxypolyethyleneglycol acrylate (addition mole number n=9), 1-bromo-2methoxyethyl acrylate, p-chlorophenyl acrylate, methyl methacrylate, ethyl methacrylate, acrylamide, methacrylamide, N-methylacrylamide, N-ethylacrylamide, N-n-propylacrylamide, N-tert-butylacrylamide, hexylacrylamide, octylacrylamide, methylvinylether, ethylvinylether, propylvinylether, butylvinylether, 2-ethylbutylvinylether, vinyl acetate, vinyl propionate, vinylpyridine, N-vinyl-2-methylimidazole, N-vinyltriazole, N-vinylpyrrolidone, ethylene, propylene, 1-butene, 1-heptene, dioctyl itaconate, dihexyl maleate, styrene, methylstyrene, dimethylstyrene, benzyl styrene, chloromethylstyrene, chlorostyrene, methyl vinylbenzoate, vinyl chlorobenzoate, acrylonitrile, methachrilonitrile, and vinyl chloride.

Of these monomers, methacrylic esters, acrylic esters, and styrenes are preferable.

The other acid polymers used in the present invention may have any structures, such as of condensation polymers, and graft polymers.

Specific examples of the acid polymer which can be used here are a copolymer of acrylic acid/methacrylic acid, a copolymer of acrylic acid/methyl acrylate, a copolymer of acrylic acid/butyl methacrylate, a copolymer of acrylic acid/2-hydroxyethyl acrylate, a copolymer of acrylic acid/acrylamide, a copolymer of acrylic acid/ethyl acrylate/butyl acrylate, polymethacrylic acid, a copolymer of methacrylic acid/methyl acrylate, a copolymer of methacrylic acid/butyl methacrylate, a copolymer of methacrylic acid/2-hydroxyethyl acrylate, a copolymer of methacrylic acid/acrylamide, a copolymer of methacrylic acid/ethyl acrylate/2-hydroxyethyl acrylate, a copolymer of AMPS/methyl acrylate, a copolymer of AMPS/butyl methacrylate, a copolymer of AMPS/2-hydroxyethyl acrylate, a copolymer of AMPS/acrylamide, a copolymer of AMPS/ethyl acrylate/butyl methacrylate, a copolymer of maleic acid/styrene, a copolymer of maleic acid/isobutylene, an acrylic acid block copolymer on polyvinylalcohol, acrylic acid graft copolymer on polyvinylalcohol, denaturated gelatin such as maleic gelatin and succinylated gelatin, and denaturated cellulose such as carboxymethylcellulose.

It is preferable to synthesize these acid polymers in accordance with a method disclosed in, for example, British Patent 1,211,039, JP-B-4-29195, JPA-47-7174, JPA-47-59743, JPA-48-31355, British Patent 941,395, U.S. Pat. Nos. 3,227,672, 3,290,417, 3,262,919, 3,245,932, 2,681,897 and 3,230,275, "Official Digest", 33 by John C. Petropoulos et al., 719–736 (1961), and "Synthesized Polymer" by MURAHASHI Shunsuke et al. ed. 246–290, 31–108. In accordance with purpose, polymerization initiator, concentration, polymerization temperature, reaction time, etc. can be easily and flexibly changed.

For example, a polymerization is performed usually at 20 to 180° C., preferably 40 to 120° C. The polymerization reaction is carried out using a radical polymerization initiator in an amount of 0.05 to 5% by weight with respect to the amount of monomers to be polymerized. Examples of the initiator are azobis compounds, peroxides, hydroperoxides, and redox catalysts such as potassium persulfate, tert-butyl peroctoate, benzoyl peroxide, isopropyl percarbonate, 2,4-dichlorobenzoyl peroxide, methylethylketoneperoxide, cumene hydroperoxide, dicumyl peroxide, and azobisisobutyronitril.

The molecular weight of the acid polymer used in the present invention is preferably $5\times10^3$ or more, more preferably, $1\times10^4$ to $5\times10^6$ (weight-average molecular weight).

In the present invention, the acid polymer is added to the outermost protective layer. When the outermost protection layer consists of 2 or more sublayers, the polymer is added to the sublayer which contains the matting agent. The amount of acid polymer added is preferably 3 to 80%, more preferably 8 to 60% by weight with respect to the amount of the gelatin binder) in the layer. The gelatin (binder) concentration of the coating liquid is preferably 3 to 8% by weight. It is necessary that 50% or more, preferably 80% or more, or most preferably, all the used amount of the acid polymer of the invention be in a soluble state, and uniformly dissolved with the gelatin (binder) in a coating solution. The acid polymer forms a continuous phase such as a film in a coated layer.

In the present invention, the acid polymer may be neutralized. The neutralization ratio of the acid polymer preferably used may vary in accordance with the type or amount of hydrophobic monomer, or the structure of a repeating unit having a carboxyl group, phosphoric acid group, or sulfuric acid group. For example, all the carboxyl groups, phosphoric acid groups, or sulfuric acid groups may take a salt structure by neutralization, or all the acid residues may take an acid structure.

Basically, the neutralization ratio may be set within a range in which the acid polymer is soluble in a mixture solution made by the acid polymer and a hydrophilic colloid, or the acid polymer can be made soluble by adding an alkali, when dissolving.

The alkali used for the neutralization may be of any type as long as it can form a salt with the acid polymer. Examples are potassium hydroxide, sodium hydroxide, lithium hydroxide, and ammonia. These alkalis may be used singly, or in combination.

The hydrophilic colloid to be mixed with the acid polymer is not limited at all, and may be any of alkali-treated, acid-treated, and enzyme-treated gelatins made from, e.g., bones and skins of, e.g., cows, pigs, whales, fishes. Further, gelatins modified by chemical modification of graft copolymerization, those modified by enzymatic modification, or those graft-polymerized with vinyl monomers can be used. The molecular weight of the gelatin is not particularly limited, but usually is in a range of several hundred thousand to several thousand.

The matting agent of the present invention, represented by the formula (1) will now be described in detail.

First, what is meant by the degradation of the graininess in the present invention will be described. For the purpose of obtaining a sufficient quantity of light, the specular light or the light having a characteristic close to the specular light is used as a light source in the case where a large screen print is formed from a color negative by using an enlargement machine. With such a light, the surface condition of the negative film is faithfully reproduced, and the matting agent present on the surface, hole marks remaining after the matting agent particles are dissolved during a developing process, or the matting agent remaining not completely dissolved but in a half-dissolved state may be observed as if the graininess is degraded.

The degradation of the graininess is a problem also in the movie film industry. More specifically an intermediate film is formed, which is printed with a specular light source having a lens system by "optical print", and the image on the intermediate film is finally printed on a movie positive film. When such a movie film is projected on a screen by use of a movie projector having a specular light source, the roughness of the film is remarkably shown as a degradation of graininess.

The matting agent of the present invention is added to the very protective layer which contains the acid polymer as mentioned before. The polymer composition ratio (mole) of the matting agent in terms of the formula (1):—$(MMA)_x$—$(EMA)_y$—$(MAA)_z$—, should be $3/7<(x+y)/z<7/3$, more preferably, $4/6<(x+y)/z<6/4$, with $5/5<(x+y)/z<6/4$ being most preferable from the viewpoint of stable manufacture of the polymer. After developing process, the matting agent of the invention is no longer present on the surface of light-sensitive material; therefore it is preferable that an appropriate amount of an alkali-insoluble matting agent, which does not dissolve out during developing process, be used as well as by the conventionally known technique, so as to prevent the stickiness of the light-sensitive material after the developing process. The matting agent particles of the polymer represented by the formula (1) and particularly preferable in the invention are preferably finely dispersed in the outermost layer of the light-sensitive material. These matting agent particles can be prepared in the form of dispersion by mixing a solution of the copolymer in a low-boiling point organic solvent such as ethyl acetate, butanol-containing ethyl actate (amount of butanol: less than 50 wt %), butanol-containing methanol (amount of butanol: less than 50 wt %), into a gelatin solution containing various surfactants, and vigorously stirring the mixture. The average particle diameter of the matting agent particles of the present invention is usually 0.5 to 10 μm, and preferably 1.0 to 5.0 μm. The matting agent polymer usually has a weight-average molecular weight of 8,000 to 100,000, preferably 10,000 to 40,000. The matting agent of the invention is usually used in an amount of 10 to 600 $mg/m^2$, and preferably 20 to 300 $mg/m^2$.

The ultraviolet (UV) absorbent used in the present invention will be described below.

The type of UV absorbent used in the present invention is not particularly limited as long as its absorption maximum wavelength falls within 400 to 300 nm. Preferably, at least one of UV absorbents represented by the following formulas (2) to (6) is used in the present invention.

Formula (2)

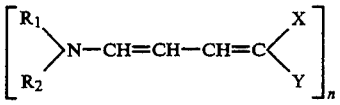

In the formula (2), each of $R_1$ and $R_2$ represents a hydrogen atom, an alkyl group having 1 to 20 carbon atoms, an alkenyl group having 3 to 20 carbon atoms, or an aryl group having 6 to 20 carbon atoms. $R_1$ and $R_2$may be the same or different, but do not represent hydrogen atoms at the same time. Further, $R_1$ and $R_2$ may form a 5- or 6-membered ring along with N. Each of X and Y represents —CN, —$COR_3$, —$COOR_3$, —$SO_2R_3$, —$CON(R_3)(R_4)$, or —COOH, and X and Y may be the same or different. Each of $R_3$ and $R_4$ represents an alkyl group having 1 to 20 carbon atoms, an aryl group having 6 to 20 carbon atoms, and $R_4$ may also be a hydrogen atom. X and Y may be combined together, and when combined, X and Y represent an atomic group required to form the nucleus of 1,3-dioxocyclohexane, barbituric acid, 1,2-diaza-3,5-dioxocyclopentane, or 2,4-diaza-l-alcoxy-3,5-dioxocyclohexene. n is 1 or 2, and when n is 2, at least one of $R_1$, $R_2$ and $R_3$ represents an alkylene group or an arylene group, and the compound may form a dimer.

More specifically, each of $R_1$ and $R_2$ represents a hydrogen atom; an alkyl group having 1 to 20 carbon atoms (for example, methyl, ethyl, n-hexyl, n-dodecyl, or eicosyl), and the alkyl group may be substituted with an appropriate substituent, such as a halogen atom, an alkoxy group, a cyano group, a hydroxyl group, an alkoxycarbonyl group, an acyloxy group, a sulfamoyl group, a sulfonamido group, an acylamino group, a carbamoyl group, a sulfo group or a carboxyl group); an alkenyl group having 3 to 20 carbon atoms (such as allyl or hexenyl); or an aryl group having 6 to 20 carbon atoms, which may be substituted with a substituent group mentioned above (for example, phenyl, tolyl, p-methoxyphenyl, or p-chlorophenyl). $R_1$ and $R_2$ may be the same, or different, but do not represent hydrogen atoms at the same time. $R_1$ and $R_2$ may form a 5- or 6-membered ring (piperidine, plperadine, morpholine) along with N.

Formula (3)

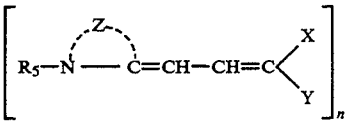

In the formula (3), Z represents an atomic group required to form an oxazolidine ring, a pyrrolidine ring, or a thiazolidine ring. $R_5$ represents an alkyl group or an aryl group. Each of X and Y represents —CN, —$COR_3$, —$COOR_3$, —$SO_2R_3$, —$CON(R_3)(R_4)$, or —COOH, and X and Y may be the same or different. $R_3$ represents an alkyl group having 1 to 20 carbon atoms, or an aryl group having 6 to 20 carbon atoms. $R_4$ may be the same as $R_3$ or represent a hydrogen atom. X and Y may be combined together, and when combined, X and Y represent an atomic group required to form the nucleus of 1,3-dioxocyclohexane, barbituric acid, 1,2-diaza-3,5-dioxocyclopentane, or 2,4-diaza-1-alcoxy-3,5-dioxocyclohexene. n is 1 or 2, and when n is 2, either one of $R_5$ and $R_3$ represents an alkylene group or arylene group, and the compound may form a dimer.

More specifically, Z represents an atomic group required to form an oxazolidine ring, a pyrrolidine ring, or a thiazolidine ring, and these rings may be substituted with an alkyl group, a substituted alkyl group, an aryl group, or a substituted aryl group. $R_5$ represents an alkyl group having 1 to 20 carbon atoms, or an aryl group having 6 to 20 carbon atoms, which may be substituted with a substituent group mentioned in connection with the formula (2). X and Y have the same meaning as mentioned in connection with formula (2). n is 1 or 2, and when n is 2, either one of $R_5$, and $R_3$ represents an alkylene group (preferably having 2 to 12 carbon atoms) or an arylene group, and the compound may form a dimer.

Formula (4)

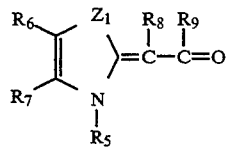

In the formula (4), $Z_1$ represents O, S, or =C ($R_{10}$)($R_{11}$), and $R_5$ represents an alkyl group or an aryl group. Each of $R_6$ and $R_7$ represents a hydrogen atom, an alkyl group having 1 to 20 carbon atoms, or an aryl group having 6 to 20 carbon atoms, and $R_6$ and $R_7$ may be combined together to form a benzene ring or a naphthalene ring. $R_8$ represents a hydrogen atom or an alkyl group, and $R_9$ represents an alkyl group or an aryl group. $R_8$ and $R_9$ may be combined together to form a nucleus of 1,3-indandione, barbituric acid, 2-thiobarbituric acid, 1,3-dioxocyclohexane, 2,4-diaza-1-alkoxy-3,5-dioxocyclohexene, 2,4-thiazolidinedione, 2-1minothiazolidin-4-one, hydantoin, 2,4-oxazolidinedione, 2-iminooxazolidin-4-one, or 2-thioxazolidine-2,4-dione. Each of $R_{10}$ and $R_{11}$ represents an alkyl group having 1 to 4 carbon atoms.

More specifically, $Z_1$ represents O, S, or =C ($R_{10}$)($R_{11}$), and $R_5$ is of the same meaning as $R_5$ in the formula (3). Each of $R_6$ and $R_7$ represents a hydrogen atom, an alkyl group having 1 to 20 carbon atoms, or an aryl group having 6 to 20 carbons, and each may be substituted with a substituent group mentioned in connection with formula (2). $R_6$ and $R_7$ may be combined together to form a benzene ring or a naphthalene ring. $R_8$ represents a hydrogen atom, or an alkyl group having 1 to 20 carbon atoms, and the alkyl group may be substituted with a substituent group mentioned above. $R_9$ represents an alkyl group having 1 to 20 carbon atoms, or an aryl group having 6–20 carbons, and each may have a substituent group mentioned above. $R_8$ and $R_9$ may be combined together to form a heterocyclic ring as mentioned above, and the heterocyclic ring may be substituted with a substituent. Each of $R_{10}$ and $R_{11}$ represents an alkyl group having 1 to 4 carbon atoms.

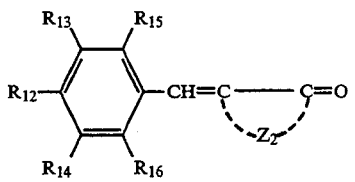

Formula (5)

In the formula (5), $Z_2$ represents an atomic group required to form a 5-oxazolone, 5-isoxazolone, 2-thiohydantoin, 2-thiooxazolidine-2,5-dione, rhodanine, or thiazolindine-2,4-dione ring. $R_{12}$ represents an alkoxy group having 1 to 20 carbon atoms, —$OCOR_{17}$, or a hydrogen atom. $R_{17}$ represents an alkoxy group having 1 to 20 carbon atoms, oran aryl group having 6 to 20 carbon atoms. Each of $R_{13}$ and $R_{14}$ represents a hydrogen atom, or an alkoxy group having 1 to 6 carbon atoms, and each of $R_{15}$ and $R_{16}$ represents an alkyl group having 1 to 4 carbon atoms, an alkoxy group having 1 to 4 carbon atoms, or a halogen atom.

More specifically, each of the above-mentioned heterocyclic rings formed with $Z_2$ may be substituted at its substitutable position with a substituted or unsubstituted alkyl group having 1 to 20 carbon atoms, or a substituted or unsubstituted aryl group having 6 to 20 carbon atoms. Examples of the substituent groups for the alkyl and aryl groups are the same as those mentioned in connection with formula (2). $R_{12}$ represents an alkoxy group having 1 to 20 carbon atoms (such as methoxy, ethoxy, or octadecyloxy), —$OCOR_{17}$, or a hydrogen atom. $R_{17}$ represents a substituted or unsubstituted alkyl group having 1 to 20 carbon atoms, or a substituted or unsubstituted aryl group having 6 to 20 carbon atoms. Examples of the substituent groups are the same as those mentioned above. Each of $R_{13}$ and $R_{14}$ represents a hydrogen atom or an alkoxy group having 1 to 6 carbon atoms (such as methoxy, ethoxy, or butoxy), and each of $R_{15}$ and $R_{16}$ represents an alkyl group having 1 to 4 carbon atoms, an alkoxy group having 1 to 4 carbon atoms, or a halogen (such as chlorine, or bromine).

The compound represented by formula (2) can be synthesized by the method disclosed in JP-A-51-56620, JP-A-60-75834, or JP-A-53-128333. The compound represented by formula (3) can be synthesized by the method disclosed in JP-A-53-133033, JP-A-53-97425, JP-A-53-134431, JP-A-53-131837, JP-A-56-27146, or JP-A-54-111826. The compound represented by formula (4) can be synthesized by the method disclosed in JP-A-54-18727, or JP-A-53-129633. The compound represented by formula (5) can be synthesized by the method disclosed in British Patent 2,083,240A or 2,083,239A.

The compounds represented by the formulas (2)–(5) can be used along with cinnamic UV absorbents disclosed in, e.g., JP-B-48-30492, and JP-B-56-21141, benzotriazole UV absorbents disclosed in, e.g., JP-B-48-5496, JP-B-50-25337, JP-B-55-36984, JP-B-49-26139, JP-B-51-6540, JP-B-47-1026, JP-A-61-190537, JP-A-1-306839, JP-A-1-306840, JP-A-1-306841, JP-A-1-306842, JP-A-1-306843, and European Patent 57-160, benzophenone UV absorbents disclosed in, e.g., JP-B-50-33773, JP-B-56-30538, and U.S. Pat. Nos. 3,698,907 and 3,215,530, and/or polymeric UV absorbents disclosed in, e.g., JP-A-58-185677, JP-A-58-111942, JP-A-58-178351, JP-A-61-169831, JP-A-62-24247, JP-A-63-55542, JP-A-63-53544, and JP-A-63-53543.

A benzotriazole UV absorbent which can be used in the present invention is represented by the following formula (6).

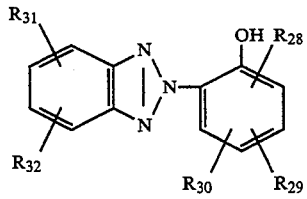

Formula (6)

In the formula (6), $R_{28}$, $R_{29}$, $R_{30}$, $R_{31}$ and $R_{32}$ are the same or different, and each represents a hydrogen atom, or a substituent substitutable on the aromatic ring, and $R_{31}$ and $R_{32}$ may close a ring to form a 5- or 6-membered aromatic ring. Of these groups, those which may have a substituent may be further substituted with an appropriate substituent.

The compound of the formula (6) can be easily prepared by the methods described in JP-B-48-5496, JP-B-25337, and JP-B-55-36984.

The compound represented by the formula (6) may be used singly or in combination thereof. The compound of the formula (6) may also be preferably used in combination with at least one of UV absorbents of formulas (2) to (5).

Typical examples of the compounds represented by formulas (2) to (6) are listed below. However, the UV absorbent of the invention should not be limited to these examples.

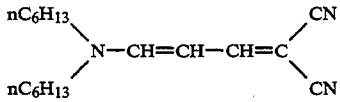

(2)-1

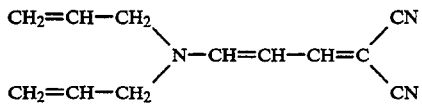

(2)-2

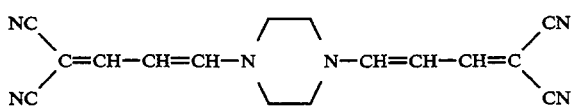

(2)-3

-continued
(2)-4
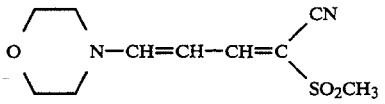
(2)-5
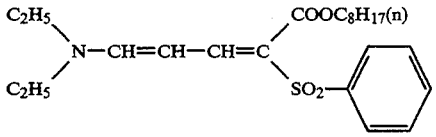
(2)-6
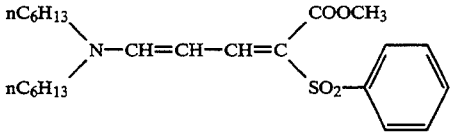
(2)-7
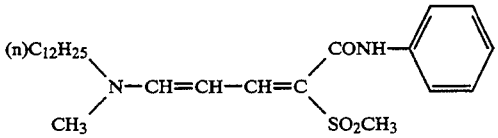
(2)-8
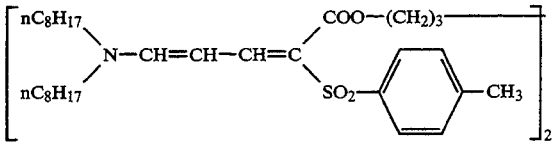
(2)-9
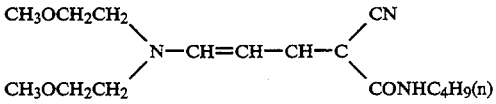
(2)-10
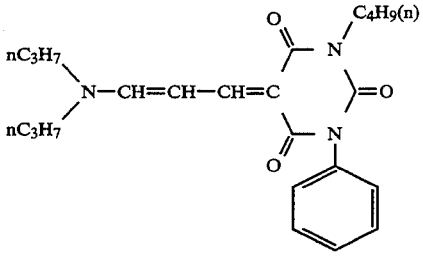
(2)-11
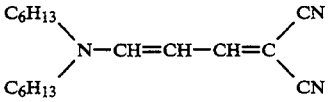
(3)-1
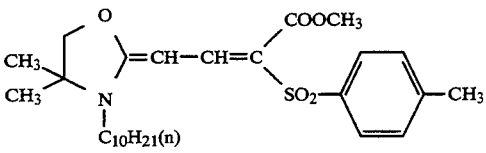
(3)-2
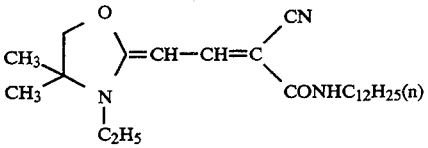

-continued
(3)-3
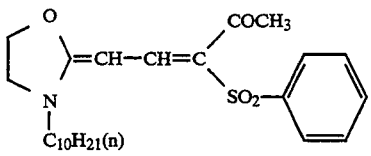
(3)-4
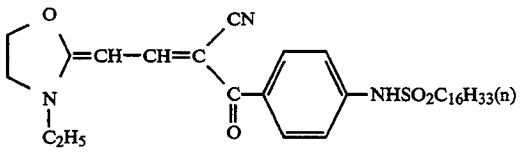
(3)-5
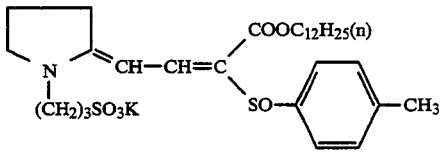
(3)-6
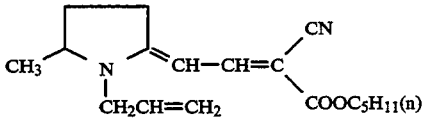
(3)-7
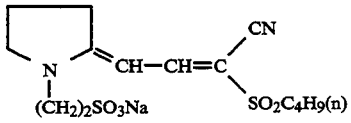
(3)-8
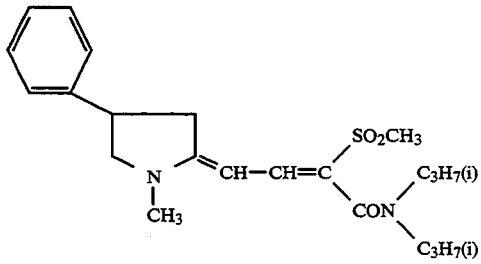
(3)-9
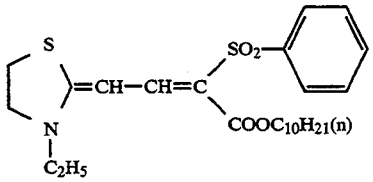
(3)-10
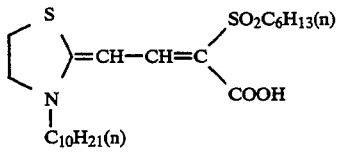
(3)-11
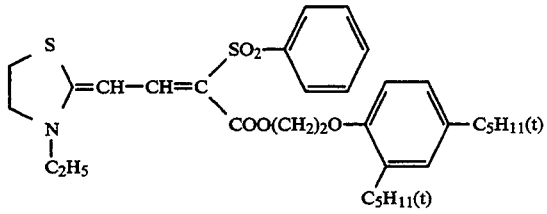

-continued
(3)-12
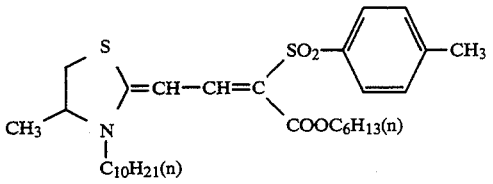
(4)-1
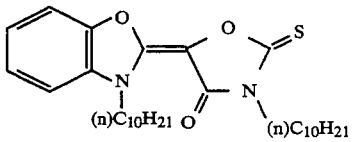
(4)-2
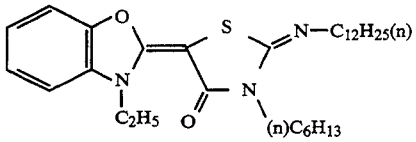
(4)-3
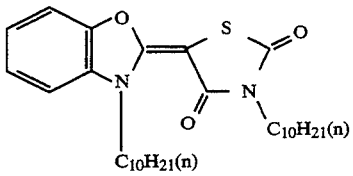
(4)-4
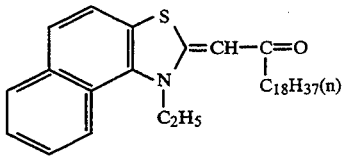
(4)-5
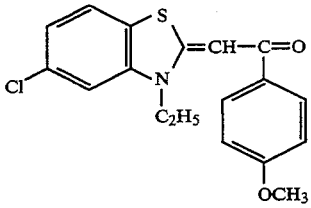
(5)-1
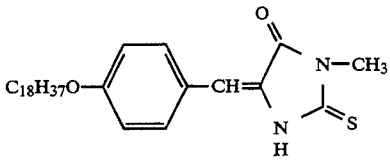
(5)-2
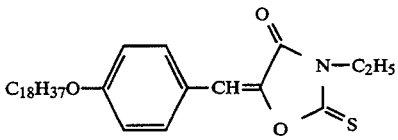
(5)-3
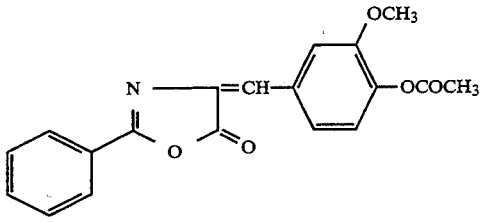

-continued
(5)-4
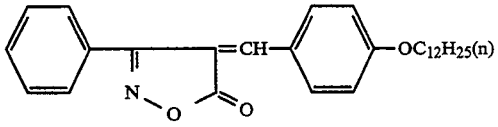
(6)-1
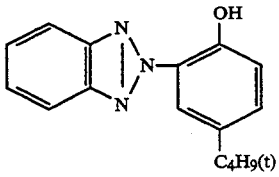
(6)-2
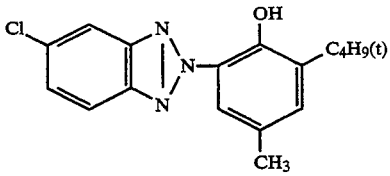
(6)-3
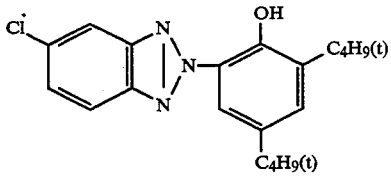
(6)-4
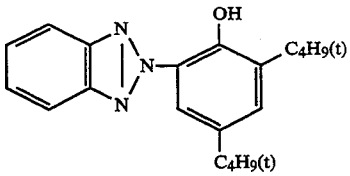
(6)-5
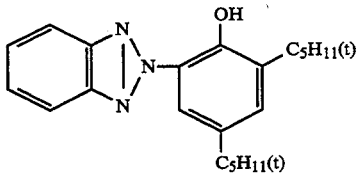
(6)-6
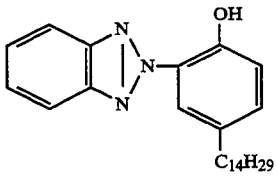
(6)-7
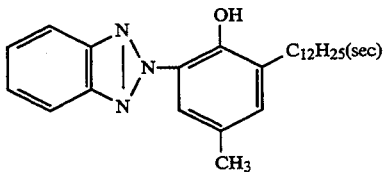
(6)-8
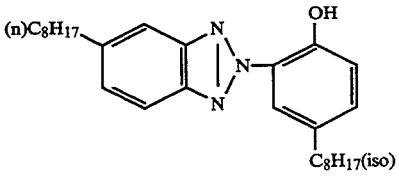

-continued

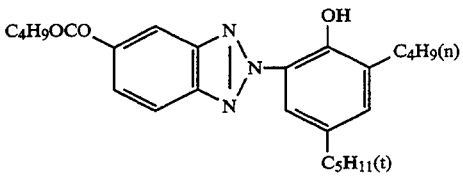

(6)-9

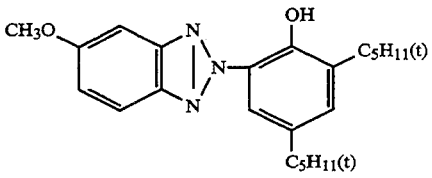

(6)-10

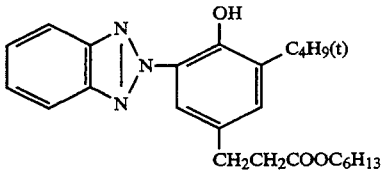

(6)-11

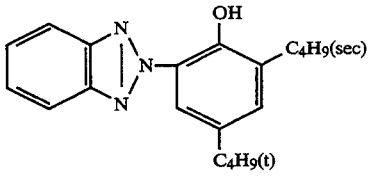

(6)-12

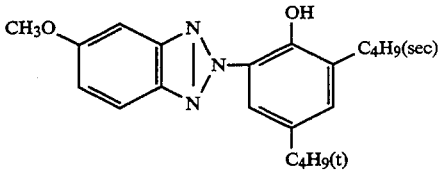

(6)-13

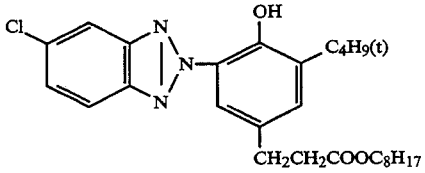

(6)-14

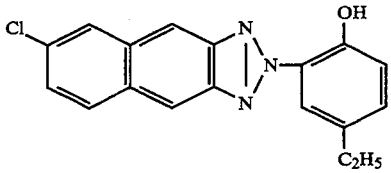

(6)-15

These UV absorbents are used in the protective layer. When the protective layer is a single layer, the absorbent is used in this layer, whereas when the protective layer consists of two or more sublayers, it is preferable that the absorbent be used in a sublayer other than the outermost sublayer, though it may be contained in any sublayer.

The amount of UV absorbent used in the present invention is usually 0.05 to 1.0 g/m$^2$, and preferably 0.1 to 0.5 g/m$^2$. The absorbents of the formulas (2) to (6) are so selected as to have an absorption maximum in a wavelength region required for photographic performance, and are used singly or in combination.

The UV absorbents used here can be added to the light-sensitive material by a conventionally known method. For example, a UV absorbent is dissolved into a mixture of a high boiling point organic solvent such as tricresyl phosphate and a low boiling point organic solvent such as ethyl acetate at a temperature of 55 to 65° C., and the mixture is added to an aqueous gelatin solution containing a surfactant a typical example of which is sodium dodecylbenzensulfonate. Then, the mixture is stirred at high speed to make an emulsified dispersion, and the dispersion is added to a coating liquid, which is then coated. Those UV absorbents which are liquid at room temperature can be emulsified and dispersed without using a high boiling point organic solvent, and are preferable in the present invention.

The light-sensitive material of the present invention needs only to have at least one of silver halide emulsion layers, i.e., a blue-sensitive layer, a green-sensitive layer, and a red-sensitive layer, each containing a color-forming coupler, and a protective layer made of a non-light-sensitive hydrophillic colloid as the outermost layer. Further, there is no particular limitation on the number of silver halide emulsion layers, or that of non-light-sensitive layers, or the order of the layers except for the outermost protective layer.

A typical example is a silver halide photographic light-sensitive material having, on a support, at least one unit light-sensitive layer constituted by a plurality of silver halide emulsion layers which are sensitive to essentially the same color but have different sensitivities or speeds. The unit light-sensitive layer is sensitive to blue, green or red light. In a multi-layered silver halide color photographic light-sensitive material, the unit light-sensitive layers are generally arranged such that red-, green-, and blue-sensitive layers are formed from a support side in the order named. However, this order may be reversed or a layer having a different color sensitivity may be sandwiched between layers having the same color sensitivity in accordance with the application.

Non-light-sensitive layers such as various types of interlayers may be formed between the silver halide light-sensitive layers and as the uppermost layer and the lowermost layer.

The interlayer may contain, e.g., couplers and DIR compounds as described in JP-A-61-43748, JP-A-59-113438, JP-A-59-113440, JP-A-61-20037, and JP-A-61-20038 or a color mixing inhibitor which is normally used.

As a plurality of silver halide emulsion layers constituting each unit light-sensitive layer, a two-layered structure of high- and low-speed emulsion layers can be preferably used as described in west German Patent 1,121,470 or British Patent 923,045. In this case, layers are preferably arranged such that the sensitivity or speed is sequentially decreased toward a support, and a non-light-sensitive layer may be formed between the silver halide emulsion layers. In addition, as described in JP-A-57-112751, JP-A-62-200350, JP-A-62-206541, and JP-A-62-206543, layers may be arranged such that a low-speed emulsion layer is formed remotely from a support and a high-speed layer is formed close to the support.

More specifically, layers may be arranged from the farthest side from a support in an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, or an order of BH/BL/GH/GL/RL/RH.

In addition, as described in JP-B-55-34932, layers may be arranged from the farthest side from a support in an order of blue-sensitive layer/GH/RH/GL/RL. Furthermore, as described in JP-A-56-25738 and JP-A-62-63936, layers may be arranged from the farthest side from a support in an order of blue-sensitive layer/GL/RL/GH/RH.

As described in JP-B-49-15495, three layers may be arranged such that a silver halide emulsion layer having the highest sensitivity is arranged as an upper layer, a silver halide emulsion layer having sensitivity lower than that of the upper layer is arranged as an intermediate layer, and a silver halide emulsion layer having sensitivity lower than that of the intermediate layer is arranged as a lower layer. In other words, three layers having different sensitivities may be arranged such that the sensitivity is sequentially decreased toward the support. When a layer structure is constituted by three layers having different sensitivities or speeds, these layers may be arranged in an order of medium-speed emulsion layer/high-speed emulsion layer/low-speed emulsion layer from the farthest side from a support in a layer having the same color sensitivity as described in JP-A-59-202464.

Also, an order of high-speed emulsion layer/low-speed emulsion layer/medium-speed emulsion layer, or low-speed emulsion layer/medium-speed emulsion layer/high-speed emulsion layer may be adopted. Furthermore, the arrangement can be changed as described above even when four or more layers are formed.

As described above, various layer configurations and arrangements can be selected in accordance with the application of the light-sensitive material.

A preferable silver halide contained in photographic emulsion layers of the photographic light-sensitive material of the present invention is silver bromoiodide, silver chloroiodide, or silver chlorobromolodide containing about 30 mol % or less of silver iodide. The most preferable silver halide is silver bromoiodide or silver chlorobromoiodide containing about 2 mol % to about 10 mol % of silver iodide.

Silver halide grains contained in the photographic emulsion may have regular crystals such as cubic, octahedral, or tetradecahedral crystals, irregular crystals such as spherical, or tabular crystals, crystals having defects such as twin planes, or composite shapes thereof.

The silver halide may consist of fine grains having a grain size of about 0.2 μm or less or large grains having a projected-area diameter of up to 10 μm, and the emulsion may be either a polydisperse emulsion or a monodisperse emulsion.

The silver halide photographic emulsion which can be used in the present invention can be prepared by methods described in, for example, Research Disclosure (RD) No. 17643 (December 1978), pp. 22 to 23, "I. Emulsion preparation and types", RD No. 18716 (November 1979), page 648, and RD No. 307105 (November 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, for example, U.S. Pat. Nos. 3,574,628 and 3,655,394, and British Patent 1,413,748 are also preferred.

Also, tabular grains having an aspect ratio of about 3 or more can be used in the present invention. The tabular grains can be easily prepared by methods described in, e.g., Gutoff, "Photographic Science and Engineering", Vol. 14, PP. 248 to 257 (1970); U.S. Pat. Nos. 4,434,226; 4,414,310; 4,433,048 and 4,499,520, and British Patent 2,112,157.

The crystal structure may be uniform, may have different halogen compositions in the interior and the surface thereof, or may be a layered structure. Alternatively, silver halides having different compositions may be joined by an epitaxial junction, or a compound other than a silver halide such as silver rhodanide or zinc oxide may be joined. A mixture of grains having various types of crystal shapes may be used.

The above emulsion may be of any of a surface latent image type in which a latent image is mainly formed on the surface of each grain, an internal latent image type in which a latent image is formed in the interior of each grain, and a type in which a latent image is formed on the surface and in the interior of each grain. However, the emulsion must be of a negative type. When the emulsion is of an internal latent image type, it may be a core/shell internal latent image type emulsion described in JP-A-63-264740. A method of preparing this core/-shell internal latent image type emulsion is described in JP-A-59-133542. Although the thickness of a shell of this emulsion changes in accordance with development or the like, it is preferably 3 to 40 nm, and most preferably, 5 to 20 nm.

A silver halide emulsion layer is normally subjected to physical ripening, chemical ripening, and spectral sensitization steps before it is used. Additives for use in these steps are described in RD Nos. 17,643; 18,716 and 307,105 and they are summarized in the table represented later.

In the light-sensitive material of the present invention, two or more types of emulsions different in at least one of features such as a grain size, a grain size distribution, a halogen composition, a grain shape, and sensitivity can be mixed and used in the same layer.

Surface-fogged silver halide grains described in U.S. Pat. No. 4,082,553, internally fogged silver halide grains described in U.S. Pat. No. 4,626,498 or JP-A-59-214852, and colloidal silver can be preferably used in a light-sensitive silver halide emulsion layer and/or a substantially non-light-sensitive hydrophilic colloid layer. The internally fogged or surface-fogged silver halide grains are silver halide grains which can be uniformly (non-imagewise) developed despite the presence of a non-exposed portion and exposed portion of the light-sensitive material. A method of preparing the internally fogged or surface-fogged silver halide grain is described in U.S. Pat. No. 4,626,498 or JP-A-59-214852.

The silver halides which form the core of the internally fogged or surface-fogged core/shell silver halide grains may be of the same halogen composition or different halogen compositions. Examples of the internally fogged or surface-fogged silver halide are silver chloride, silver bromochloride, silver bromoiodide, and silver bromochloroiodide. Although the grain size of these fogged silver halide grains is not particularly limited, an average grain size is preferably 0.01 to 0.75 μm, and most preferably, 0.05 to 0.6 μm. The grain shape is also not particularly limited, and may be a regular grain shape. Although the emulsion may be a polydisperse emulsion, it is preferably a monodisperse emulsion (in which at least 95% in weight or number of silver halide grains have a grain size falling within a range of ±40% of the average grain size).

In the present invention, a non-light-sensitive fine grain silver halide is preferably used. The non-light-sensitive fine grain silver halide means silver halide fine grains not sensitive upon imagewise exposure for obtaining a dye image and essentially not developed in development. The non-light-sensitive fine grain silver halide is preferably not fogged beforehand.

The fine grain silver halide contains 0 to 100 mol % of silver bromide and may contain silver chloride and/or silver iodide as needed. Preferably, the fine grain silver halide contains 0.5 to 10 mol % of silver iodide.

An average grain size (an average value of equivalent-circle diameters of projected areas) of the fine grain silver halide is preferably 0.01 to 0.5 μm, and more preferably, 0.02 to 0.2 μm.

The fine grain silver halide can be prepared by a method similar to a method of preparing normal light-sensitive silver halide. In this preparation, the surface of a silver halide grain need not be subjected to either chemical sensitization or spectral sensitization. However, before the silver halide grains are added to a coating solution, a known stabilizer such as a triazole compound, an azaindene compound, a benzothiazolium compound, a mercapto compound, or a zinc compound is preferably added. This fine grain silver halide grain-containing layer preferably contains colloidal silver.

A coating silver amount of the light-sensitive material of the present invention is preferably 6.0 g/m$^2$ or less, and most preferably, 4.5 g/m$^2$ or less.

Known photographic additives usable in the present invention are also described in the above three RDs, and they are summarized in the following Table:

| Additives | RD17643 | RD18716 | RD307105 |
|---|---|---|---|
| 1. Chemical sensitizers | page 23 | page 648, right column | page 866 |
| 2. Sensitivity-increasing agents | | page 648, right column | |
| 3. Spectral sensitizers, supersensitizers | pp. 23–24 | page 648, right column to page 649, right column | pp. 866–868 |
| 4. Brighteners | page 24 | page 648, right column | page 868 |
| 5. Antifoggants, stabilizers | pp. 24–25 | page 649, right column | pp. 868–870 |
| 6. Light absorbent, filter dye, ultraviolet absorbents | pp. 25–26 | page 649, right column to page 650, left column | page 873 |
| 7. Stain-preventing agents | page 25, right column | page 650, left-right columns | page 872 |
| 8. Dye image-stabilizer | page 25 | page 650, left column | page 872 |
| 9. Hardening agents | page 26 | page 651, left column | pp. 874–875 |
| 10. Binder | page 26 | page 651, left column | pp. 873–874 |
| 11. Plasticizers, lubricants | page 27 | page 650, right column | page 876 |
| 12. Coating aids, surface active agents | pp. 26–27 | page 650, right column | pp. 875–876 |
| 13. Antistatic agents | page 27 | page 650, right column | pp. 876–877 |
| 14. Matting agent | | | pp. 878–879 |

In order to prevent degradation in photographic properties caused by formaldehyde gas, a compound described in U.S. Pat. No. 4,411,987 or 4,435,503, which can react with formaldehyde and fix the same, is preferably added to the light-sensitive material.

The light-sensitive material of the present invention preferably contains a mercapto compound described in U.S. Pat. No. 4,740,454 and 4,788,132, JP-A-62-18539, and JP-A-1-283551.

The light-sensitive material of the present invention preferably contains compounds which release, regardless of a developed silver amount produced by the development, a fogging agent, a development accelerator, a silver halide solvent, or precursors thereof, described in JP-A-1-106052.

The light-sensitive material of the present invention preferably contains dyes dispersed by methods described in International Disclosure WO 88/04794 and JP-A-1-502912 or dyes described in European Patent 317,308A, U.S. Pat. No. 4,420,555, and JP-A-1-259358.

Various color couplers can be used in the present invention, and specific examples of these couplers are described in patents described in the above-mentioned RD No. 17643, VII-C to VII-G and RD No. 307105, VII-C to VII-G.

Preferable examples of yellow couplers are described in, e.g., U.S. Pat. Nos. 3,933,501; 4,022,620; 4,326,024; 4,401,752 and 4,248,961, JP-B-58-10739, British Patents 1,425,020 and 1,476,760, U.S. Pat. Nos. 3,973,968; 4,314,023 and 4,511,649, and European Patent 49,473A.

Examples of a magenta coupler are preferably 5-pyrazolone type and pyrazoloazole type compounds, and more preferably, compounds described in, for example, U.S. Pat. Nos. 4,310,619 and 4,351,897, European Patent 73,636, U.S. Pat. Nos. 3,061,432 and 3,725,067, RD No. 24220 (June 1984), JP-A-60-33552, RD No. 24230 (June 1984), JP-A-60-43659, JP-A-61-72238, JP-A-60-35730, JP-A-55-118034, JP-A-60-185951, U.S. Pat. Nos. 4,500,630; 4,540,654 and 4,556,630, and WO No. 88/04795.

Examples of a cyan coupler are phenol type and naphthol type ones. Of these, preferable are those described in, for example, U.S. Pat. Nos. 4,052,212; 4,146,396; 4,228,233; 4,296,200; 2,369,929; 2,801,171; 2,772,162; 2,895,826; 3,772,002; 3,758,308; 4,343,011 and 4,327,173, West German Patent Laid-open Application 3,329,729, European Patents 121,365A and 249,453A, U.S. Pat. Nos. 3,446,622; 4,333,999; 4,775,616; 4,451,559; 4,427,767; 4,690,889;4,254,212 and 4,296,199, and JP-A-61-42658. Also, the pyrazoloazole type couplers disclosed in JP-A-64-553, JP-A-64-554, JP-A-64-555 and JP-A-64-556, and imidazole type couplers disclosed in U.S. Pat. No. 4,818,672 can be used as cyan coupler in the present invention.

Typical examples of a polymerized dye-forming coupler are described in, e.g., U.S. Pat. Nos. 3,451,820; 4,080,211; 4,367,282; 4,409,320 and 4,576,910, British Patent 2,102,173, and European Patent 341,188A.

Preferable examples of a coupler capable of forming colored dyes having proper diffusibility are those described in U.S. Pat. No. 4,366,237, British Patent 2,125,570, European Patent 96,570, and West German Laid-open Patent Application No. 3,234,533.

Preferable examples of a colored coupler for correcting unnecessary absorption of a colored dye are those described in RD No. 17643, VII-G, RD No. 30715, VII-G, U.S. Pat. No. 4,163,670, JP-B-57-39413, U.S. Pat. Nos. 4,004,929 and 4,138,258, and British Patent 1,146,368. A coupler for correcting unnecessary absorption of a colored dye by a fluorescent dye released upon coupling described in U.S. Pat. No. 4,774,181 or a coupler having a dye precursor group which can react with a developing agent to form a dye as a split-off group described in U.S. Pat. No. 4,777,120 may be preferably used.

Those compounds which release a photographically useful residue upon coupling may also be preferably used in the present invention. DIR couplers, i.e., couplers releasing a development inhibitor, are preferably those described in the patents cited in the above-described RD NO. 17643, VII-F and RD No. 307105, VII-F, JP-A-57-151944, JP-A-57-154234, JP-A-60-184248, JP-A-63-37346, JP-A-63-37350, and U.S. Pat. Nos. 4,248,962 and 4,782,012.

Preferable examples of a coupler which imagewise releases a nucleating agent or a development accelerator are preferably those described in British Patents 2,097,140 and 2,131,188, JP-A-59-157638, and JP-A-59-170840. In addition, compounds releasing, e.g., a fogging agent, a development accelerator, or a silver halide solvent upon redox reaction with an oxidized form of a developing agent, described in JP-A-60-107029, JP-A-60-252340, JP-A-1-44940, and JP-A-1-45687, can also be preferably used.

Examples of other compounds which can be used in the light-sensitive material of the present invention are competing couplers described in, for example, U.S. Pat. No. 4,130,427; poly-equivalent couplers described in, e.g., U.S. Pat. Nos. 4,283,472, 4,338,393, and 4,310,618; a DIR redox compound releasing coupler, a DIR coupler releasing coupler, a DIR coupler releasing redox compound, or a DIR redox releasing redox compound described in, for example, JP-A-60-185950 and JP-A-62-24252; couplers releasing a dye which restores color after being released described in European Patent 173,302A and 313,308A; a bleach accelerator-releasing coupler disclosed in, e.g., RD Nos. 11449 and 24241, and JP-A-63-75747; a ligand releasing coupler described in, e.g., U.S. Pat. No. 4,553,477; a coupler releasing a leuco dye described in JP-A-63-75747; and a coupler releasing a fluorescent dye described in U.S. Pat. No. 4,774,181.

The couplers for use in this invention can be introduced into the light-sensitive material by various known dispersion methods.

Examples of a high-boiling point organic solvent to be used in the oil-in-water dispersion method are described in, e.g., U.S. Pat. No. 2,322,027. Examples of a high-boiling point organic solvent to be used in the oil-in-water dispersion method and having a boiling point of 175° C. or more at atmospheric pressure are phthalic esters (e.g., dibutylphthalate, dicyclohexylphthalate, di-2-ethylhexylphthalate, decylphthalate, bis(2,4-di-t-amylphenyl) phthalate, bis(2,4-di-t-amylphenyl) isophthalate, bis(1,1-di-ethylpropyl) phthalate), phosphate or phosphonate esters (e.g., triphenylphosphate, tricresylphosphate, 2-ethylhexyldiphenylphosphate, tricyclohexylphosphate, tri-2-ethylhexylphosphate, tridodecylphosphate, tributoxyethylphosphate, trichloropropylphosphate, and di-2-ethylhexylphenylphosphonate), benzoate esters (e.g., 2-ethylhexylbenzoate, dodecylbenzoate, and 2-ethylhexyl-p-hydroxybenzoate), amides (e.g., N,N-diethyldodecaneamide, N,N-diethyllaurylamide, and N-tetradecylpyrrolidone), alcohols or phenols (e.g., isostearyl alcohol and 2,4-di-tert-amylphenol), aliphatic carboxylate esters (e.g., bis(2-ethylhexyl) sebacate, dioctylazelate, glycerol-tributyrate, isostearyllactate, and trioctylcitrate), an aniline derivative (e.g., N,N-dibutyl-2-butoxy-5-tertoctylaniline), and hydrocarbons (e.g., paraffin, dodecylbenzene, and diisopropylnaphthalene). An organic solvent having a boiling point of about 30° C. or more, and preferably, 50° C. to about 160° C. can be used as an auxiliary solvent. Typical examples of the auxiliary solvent are ethyl acetate, butyl acetate, ethyl propionate, methylethylketone, cyclohexanone, 2-ethoxyethylacetate, and dimethylformamide.

Steps and effects of a latex dispersion method and examples of a immersing latex are described in, e.g., U.S. Pat. No. 4,199,363 and German Laid-open Patent Application (OLS) Nos. 2,541,274 and 2,541,230.

Various types of antiseptics and fungicides agent are preferably added to the color light-sensitive material of the present invention. Typical examples of the antiseptics and the fungicides are phenethyl alcohol, and 1,2-benzisothiazolin-3-one, n-butyl p-hydroxyenzoate, phenol, 4-chloro-3,5-dimethylphenol, 2-phenoxyethanol, and 2-(4-thiazolyl)benzimidazole, which are described in JP-A-63-257747, JP-A-62-272248, and JP-A-1-80941.

The present invention can be applied to various color light-sensitive materials. Examples of the material are a color negative film for a general purpose or a movie, a color intermediate film, a color reversal film for a slide or a television, and a color positive film for a movie.

A support which can be suitably used in the present invention is described in, e.g., RD. No. 17643, page 28, RD. No. 18716, from the right column, page 647 to the left column, page 648, and RD. No. 307105, page 879.

In the light-sensitive material of the present invention, the sum total of film thicknesses of all hydrophilic colloidal layers at the side having emulsion layers is preferably 28 μm or less, more preferably, 23 μm or less, much more preferably, 18 μm or less, and most preferably, 16 μm or less. A film swell speed $T_{\frac{1}{2}}$ is preferably 30 seconds or less, and more preferably, 20 seconds or less. The film thickness means a film thickness measured under moisture conditioning at a temperature of 25° C. and a relative humidity of 55% (two days). The film swell speed $T_{\frac{1}{2}}$ can be measured in accordance with a known method in the art. For example, the film swell speed $T_{\frac{1}{2}}$ can be measured by using a swello-meter described by A. Green et al. in Photographic Science & Engineering, Vol. 19, No. 2, pp. 124 to 129. When 90% of a maximum swell film thickness reached by performing a treatment by using a color developer at 30° C. for 3 minutes and 15 seconds is defined as a saturated film thickness, $T_{\frac{1}{2}}$ is defined as a time required for reaching ½ of the saturated film thickness.

The film swell speed $T_{\frac{1}{2}}$ can be adjusted by adding a film hardening agent to gelatin as a binder or changing aging conditions after coating. A swell ratio is preferably 150% to 400%. The swell ratio is calculated from the maximum swell film thickness measured under the above conditions in accordance with a relation:

(maximum swell film thickness—film thickness)/film thickness.

In a light-sensitive material of the present invention, a hydrophilic colloid layer (called back layer) having a total dried film thickness of 2 to 20 μm, or a polymer layer containing colloidal carbon (resin back layer) may be formed on the side opposite to the side having emulsion layers. The resin back layer usually has a thickness of 0.5 to 3 μm, and its optical transmission density is 0.5 to 1.5 as measured with white light. The resin back layer is dissolved in an alkali bath (pre-bath) during development processing, and washed out in a subsequent rinsing step.

The color photographic light-sensitive material according to the present invention can be developed by conventional methods described in RD. NO. 17643, pp. 28 and 29, RD. NO. 18716, the left to right columns, page 651, and RD. No. 307105, pp. 880 and 881.

A color developer used in development of the light-sensitive material of the present invention is an aqueous alkaline solution containing as a main component, preferably, an aromatic primary amine color developing agent. As the color developing agent, although an aminophenol compound is effective, a p-phenylenediamine compound is preferably used. Typical examples of the p-phenylenediamine compound are: 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfates, hydrochlorides and p-toluenesulfonates thereof. Of these compounds, 3-methyl-4-amino-N-ethyl-N-⊖hydroxyethylaniline, and the sulfates thereof are preferred in particular. The above compounds can be used in a combination of two or more thereof in accordance with the application.

In general, the color developer contains a pH buffering agent such as a carbonate, a boroate or a phosphoate of an alkali metal, and a development restrainer or an antifoggant such as chloride, a bromide, an iodide, a benzimidazole, a benzothiazole, or a mercapto compound. If necessary, the color developer may also contain a preservative such as hydroxylamine, diethylhydroxylamine, a sulfite, a hydrazine such as N,N-biscarboxymethylhydrazine, a phenylsemicarbazide, triethanolamine, or a catechol sulfonic acid; an organic solvent such as ethyleneglycol or diethyleneglycol; a development accelerator such as benzylalcohol, polyethyleneglycol, a quaternary ammonium salt or an amine; a dye-forming coupler; a competing coupler; an auxiliary developing agent such as 1-phenyl-3-pyrazolidone; a viscosity-imparting agent; and a chelating agent such as an aminopolycarboxylic acid, an aminopolyphosphonic acid, an alkylphosphonic acid, or a phosphonocarboxylic acid. Examples of the chelating agent are ethylenediaminetetraacetic acid, nitrilotriacetic acid, diethyleneriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

In order to perform reversal development, black-and-white development is performed and then color development is performed. As a black-and-white developer, a well-know black-and-white developing agent, e.g., a dihydroxybenzene such as hydroquinone, a 3-pyrazolidone such as 1-phenyl-3-pyrazolidone, and an aminophenol such as N-methyl-p-aminophenol can be used single or in a combination of two or more thereof. The pH of the color and black-and-white developers is generally 9 to 12.

The photographic emulsion layer is generally subjected to bleaching after color development. The bleaching may be performed either simultaneously with fixing (bleach-fixing) or independently thereof. In addition, in order to increase a processing speed, bleach-fixing may be performed after bleaching. Also, processing may be performed in a bleach-fixing bath having two continuous tanks, fixing may be performed before bleach-fixing, or bleaching may be performed after bleach-fixing, in accordance with the application. Examples of the bleaching agent are compounds of a polyvalent metal, e.g., iron (III); peracids; quinones; and nitro compounds. Typical examples of the bleaching agent are an organic complex salt of iron (III), e.g., a complex salt with an aminopolycarboxylic acid such as ethylenediaminetetraacetic acid, diethylenetriaminepentaacetic acid, cyclohexanediaminetetraacetic acid, methyliminodiacetic acid, and 1,3-diaminopropanetetraacetic acid, and glycoletherdiaminetetraacetic acid; or a complex salt with a citric acid, tartaric acid, or malic acid. Of these compounds, an iron (III) complex salt of an aminopolycarboxylic acid such as an iron (III) complex salt of ethylenediaminetetraacetic acid or 1,3-diaminopropanetetraacetic acid is preferred because it can increase a processing speed and prevent an environmental contamination. The iron (III) complex salt of an aminopolycarboxylic acid is useful in both the bleaching and bleach-fixing solutions. The pH of the bleaching or bleach-fixing solution using the iron (III) complex salt of an aminopolycarboyxlic acid is normally 4.0 to 8. In order to increase the processing speed, however, processing can be performed at a lower pH.

A bleaching accelerator can be used in the bleaching solution, the bleach-fixing solution, and their pre-bath, if necessary. Examples of a useful bleaching accelerator are: compounds having a mercapto group or a disulfide group described in, for example, U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and RD No. 17129 (July, 1978); thiazolidine derivatives described in JP-A-50-140129; thiourea derivatives described in JP-B-45-8506, JP-A-52-20832, JP-A-53-32735, and U.S. Pat. No. 3,706,561; iodide salts described in West German Patent 1,127,715 and JP-A-58-16235; polyoxyethylene compounds described in West German Patents 966,410 and 2,748,430; polyamine compounds described in JP-B-45-8836; compounds described in JP-A-49-40943, JP-A-49-59644, JP-A-53-94927, JP-A-54-35727, JP-A-55-26505, and JP-A-58-163940; and a bromide ion. Of these compounds, a compound having a mercapto group or a disulfide group is preferable since the compound has a large accelerating effect. In particular, compounds described in U.S. Pat. No. 3,893,858, West German Patent 1,290,812, and JP-A-53-95630 are preferred. A compound described in U.S. Pat. No. 4,552,834 is also preferable. These bleaching accelerators may be added in the light-sensitive material. These bleaching accelerators are useful especially in bleach-fixing of a photographic color light-sensitive material.

The bleaching solution or the bleach-fixing-solution preferably contains, in addition to the above compounds, an organic acid in order to prevent a bleaching stain. The most preferable organic acid is a compound having an acid dissociation constant (pKa) of 2 to 5, e.g., acetic acid, or propionic acid.

Examples of the fixing agent used in the fixing solution or the bleach-fixing solution are a thiosulfate salt, a thiocyanate salt, a thioether-based compound, a thiourea and a large amount of an iodide. Of these compounds, a thiosulfate, especially, ammonium thiosulfate, can be used in the widest range of applications. In addition, a combination of a thiosulfate with a thiocyanate, a thioether-based compound or thiourea is preferably used. As a preservative of the fixing solution or the bleach-fixing solution, a sulfite, a bisulfite, a carbonyl bisulfite adduct, or a sulfinic acid compound described in European Patent 294,769A is preferred. Further, in order to stabilize the fixing solution or the bleach-fixing solution, various types of aminopolycarboxylic acids or organic phosphonic acids are preferably added to the solution.

The photographic light-sensitive material of the present invention is normally subjected to washing and/or stabilizing steps after deslivering. An amount of water used in the washing step can be arbitrarily determined over a broad range in accordance with the properties (e.g., a property determined by the substances used, such as a coupler) of the light-sensitive material, the application of the material, the temperature of the water, the number of water tanks (the number of stages), a replenishing scheme representing a counter or forward current, and other conditions.

The pH of the water for washing the photographic light-sensitive material of the present invention is 4 to 9, and preferably, 5 to 8. The water temperature and the washing time can vary in accordance with the properties and applications of the light-sensitive material. Normally, the washing time is 20 seconds to 10 minutes at a temperature of 15° C. to 45° C., and preferably, 30 seconds to 5 minutes at 25° C. to 40° C.

The silver halide color light-sensitive material of the present invention exerts its advantages more effectively when applied to a film unit equipped with a lens disclosed in JP-B-2-32615 or Examined Published Japanese Utility Model Application (JU-B) 3-39784.

The present invention will now be described in detail with reference to examples; however the present invention should not be limited to these examples.

EXAMPLE 1

A multi-layered color light-sensitive material was prepared by coating layers having the following compositions on a thriacetylcellulose film support, thereby obtaining a sample 101.

Numerals indicate an addition amount per $m^2$, and the amount of silver halide used is represented in terms of silver amount.

| | |
|---|---|
| Layer 1: Intermediate layer | |
| Gelatin | 0.91 |
| Layer 2: Intermediate layer | |
| Cpd-1 | 0.064 |
| C-1 | 0.074 |
| Dye I | 0.010 |
| Gelatin | 2.279 |
| Layer 3: First red-sensitive emulsion layer | |
| Silver bromoiodide emulsion 1 (AgI content: 3.5 mol %, average grain size: 0.09 μm, variation coefficient: 11.2%, cubic) | 0.27 |
| Sensitizing dye I | $1.7 \times 10^{-3}$ |
| C-2 | 0.503 |
| C-1 | 0.056 |
| HBS-1 | 0 × 0.147 |
| HBS-2 | 0.124 |
| Gelatin | 2.801 |
| Layer 4: (Second red-sensitive emulsion layer) | |
| Silver bromoiodide emulsion 2 (AgI content: 3.5 mol %, average grain size: 0.14 μm, variation coefficient: 8.8%, cubic) | 0.102 |
| Sensitizing dye I | $2.9 \times 10^{-4}$ |
| C-2 | 0.190 |
| HBS-1 | 0.056 |
| HBS-2 | 0.047 |
| Gelatin | 0.893 |
| Layer 5: (Third red-sensitive emulsion layer) | |
| Silver bromoiodide emulsion 3 (AgI content: 3.5 mol %, average grain size: 0.22 μm, variation coefficient: 13.1%, cubic) | 0.327 |
| Sensitizing dye I | $3.3 \times 10^{-4}$ |
| C-2 | 0.128 |
| HBS-1 | 0.037 |
| HBS-2 | 0.031 |
| Gelatin | 1.083 |
| Layer 6: (Intermediate layer) | |
| Cpd-1 | 0.126 |
| Dye I | 0.134 |
| Dye III | 0.013 |
| Gelatin | 0.649 |
| Layer 7: (First green-sensitive emulsion layer) | |

-continued

| | |
|---|---|
| Silver bromoiodide emulsion 4 (AgI content: 3.5 mol %, average grain size: 0.10 μm, variation coefficient: 11.5%, cubic) | 0.405 |
| Sensitizing dye I | $3.0 \times 10^{-3}$ |
| Sensitization dye II | $3.2 \times 10^{-4}$ |
| C-3 | 0.259 |
| C-4 | 0.101 |
| C-5 | 0.053 |
| HBS-1 | 0.522 |
| Gelatin | 2.834 |
| Layer 8: (Second green-sensitive emulsion layer) | |
| Silver bromoiodide emulsion 2 | 0.122 |
| Sensitizing dye II | $5.3 \times 10^{-4}$ |
| Sensitizing dye III | $5.5 \times 10^{-5}$ |
| C-3 | 0.075 |
| C-6 | $8.3 \times 10^{-3}$ |
| C-4 | 0.029 |
| C-5 | 0.017 |
| HBS-1 | 0.151 |
| Gelatin | 0.613 |
| Layer 9: (Third green-sensitive emulsion layer) | |
| Silver bromoiode emulsion 5 (AgI content: 3.5 mol %, average grain size: 0.18 μm, variation coefficient: 7.5%, cubic) | 0.407 |
| Sensitizing dye II | $1.7 \times 10^{-3}$ |
| Sensitizing dye III | $1.8 \times 10^{-4}$ |
| C-3 | 0.083 |
| C-6 | $9.1 \times 10^{-3}$ |
| C-4 | 0.032 |
| C-5 | 0.019 |
| HBS-1 | 0.167 |
| Gelatin | 0.833 |
| Layer 10: (Yellow filter layer) | |
| Yellow colloidal silver | 0.155 |
| Cpd-1 | 0.099 |
| Cpd-2 | 0.037 |
| Gelatin | 1.009 |
| Layer 11: (First blue-sensitive emulsion layer) | |
| Silver bromochloroiodide emulsion 6 (AgCl content: 5.0 mol %, AgI content: 1.0 mol %, average grain size: 0.16 μm, variation coefficient: 8.1%, cubic) | 0.179 |
| Silver bromochloroiodide emulsion 7 (AgCl content: 5.0 mol %, AgI content: 1.0 mol %, average grain size: 0.18 μm, variation coefficient: 7.6%, cubic) | 0.020 |
| Sensitizing dye IV | $2.1 \times 10^{-3}$ |
| C-7 | 0.675 |
| C-2 | 0.028 |
| HBS-1 | 0.262 |
| Gelatin | 1.407 |
| Layer 12: (Second blue-sensitive emulsion layer) | |
| Silver bromochloroiodide emulsion 7 | 0.219 |
| Silver bromoiodide emulsion 8 (AgI content: 0.27 mol %, variation coefficient: 8.2%, cubic) | 0.029 |
| Sensitizing dye IV | $2.7 \times 10^{-3}$ |
| C-7 | 0.292 |
| C-2 | 0.012 |
| HBS-1 | 0.113 |
| Gelatin | 0.506 |
| Layer 13: (Third blue-sensitive emulsion layer) | |
| Silver bromoiodide emulsion 8 | 0.367 |
| Sensitizing dye IV | $2.3 \times 10^{-3}$ |
| C-7 | 0.068 |
| C-2 | $2.9 \times 10^{-3}$ |
| HBS-1 | 0.027 |
| Gelatin | 0.576 |
| Layer 14: (First protective layer) | |
| Silver bromoiodide emulsion 9 (AgI content: 1 mol %, equivalent-sphere diameter: 0.07 μm, variation coefficient: 15%, diameter/thickness ratio: 1.3) | 0.218 |
| Sensitizing dye IV | 0.031 |
| Gelatin | 0.350 |

-continued

| | |
|---|---|
| Layer 15: (Second protective layer) | |
| B-1 (Alkali-soluble matting agent) | 0.100 |
| B-2 (Alkali-soluble matting agent) | 0.006 |
| B-3 | 0.044 |
| W-1 | 0.136 |
| W-2 | $8.2 \times 10^{-3}$ |
| Gelatin | 0.850 |

The sample contained 1,2-benzisothiazolin-3-one (average 200 ppm to gelatin), n-butyl-p-hydroxybenzoate (about 1000 ppm to gelatin), and 2-phenoxyethanol (about 10,000 ppm to gelatin), in addition to the above-mentioned substances.

F-1, F-2, and F-4 were also added to the sample. In addition, surfactants W-3, W-4 and W-5 were added as emulsifying dispersants, and H-1 were added as a film hardener.

A coating solution for a back layer, having the following composition was prepared, and applied on the opposite side of the support to the emulsion layers such that an optical transmission density of 1.0 was given with respect to white light.

| (back layer) | |
|---|---|
| Copolymer of methyl methacrylate-methacrylic acid (copolymerization mole ratio 1:1) | 1.5 parts |
| Cellulose acetate hexahydrophthalate (hydroxypropyl group: 4%, methyl group: acetyl group: 8%, phthalyl group: 36%) | 1.5 parts |
| Acetone | 50 parts |
| Methanol | 25 parts |
| Methyl cellosolve | 25 parts |
| Colloidal carbon | 1.2 parts |

Preparation of samples 102 to 105

Samples 102 to 105 were prepared in the same manner as the sample 101 except that the composition of B-1 (matting agent) of the layer 15 was changed to x/y/z=3.5/3.5/3, 3/3/4, 2.5/2.5/5, and 2/2/6. In the case of x/y/z=2/2/6, the pH of the coating liquid was set at low in order to improve the particle stability in the coating liquid.

Preparation of samples 106 to 110

The acid polymer P-1 of the present invention was added to each of samples 101 to 105 in amount of 25 wt % with respect to gelatin, and exemplified compounds (6)-4 and (2)-5 were added to the layer 14 as UV absorbents, both at a rate of 0.12g/m$^2$, thereby obtaining samples 106 to 110.

The acid polymer was added in the form of an aqueous solution of pH 8.0 to the coating liquid of the layer 15 (protective layer), while being stirred.

Preparation of samples 111 and 112

The UV absorbent was removed from the layer 14 of each of the samples 108 and 109, thereby obtaining samples 111 and 112.

Preparation of samples 113 and 114

Samples 113 and 114 were prepared in the same manner as that of the sample 108 except that the composition of the matting agent was changed from x/y/z/=3/3/4 to 0/6/4 and 6/0/4, respectively. The amount of each matting agent was the same as that of the sample 108.

Preparation of samples 115 to 117

Samples 115 to 117 were prepared by changing the acid polymer of the sample 108 from p-1 to P-2, P-3, and P-4, respectively.

Preparation of samples 118 and 119

Samples 118 and 119 were prepared in the same manner as sample 108 except that the amount of the acid polymer $P_1$ in the layer 15 was changed from 25% with respect to the amount of gelatin, to 4% and 60%, respectively.

The following are chemical formulas of the compounds used in Example 1.

Sensitizing dye I

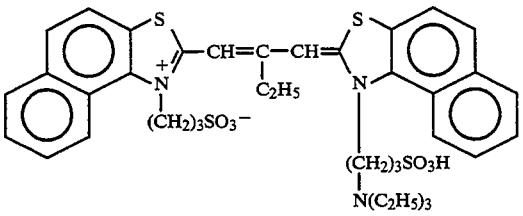

Sensitizing dye II

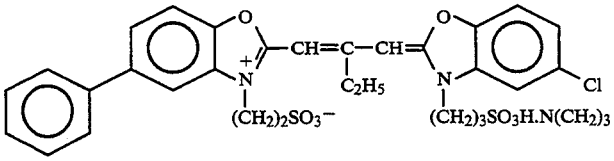

Sensitizing dye III

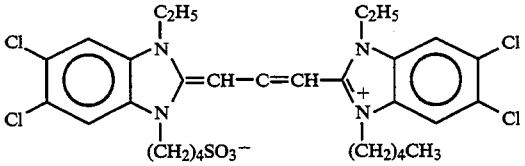

Sensitizing dye IV

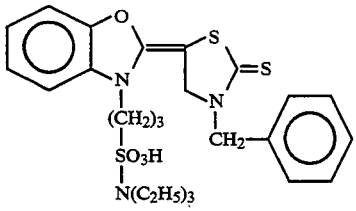

Dye I

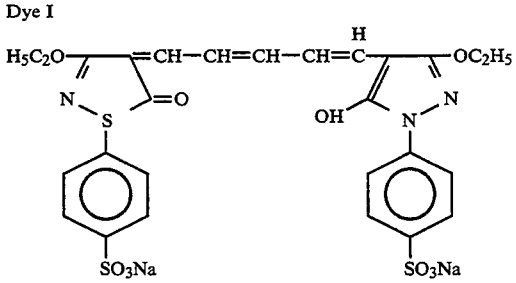

Dye II

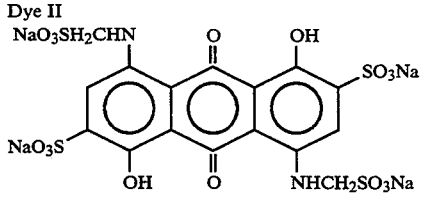

Dye III

-continued
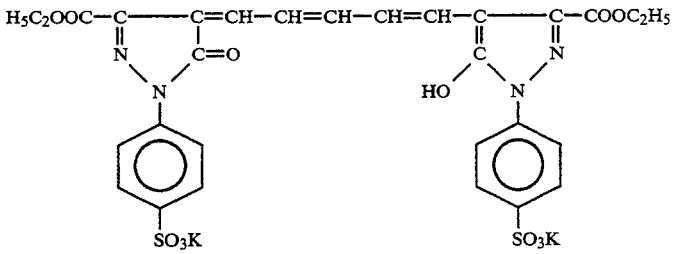
Dye IV
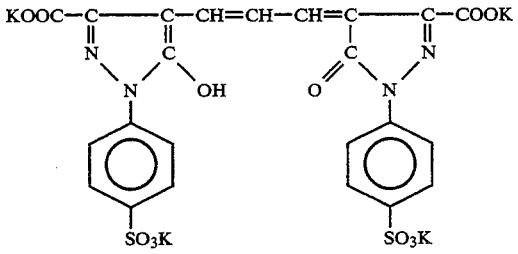
C-1
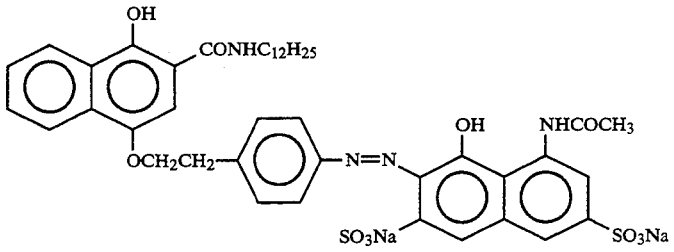
C-2
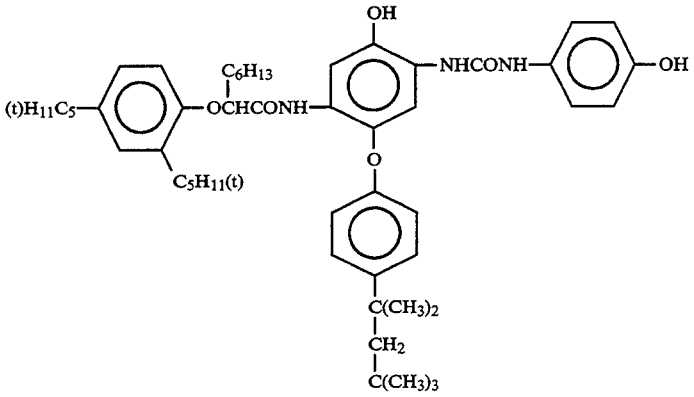
C-3
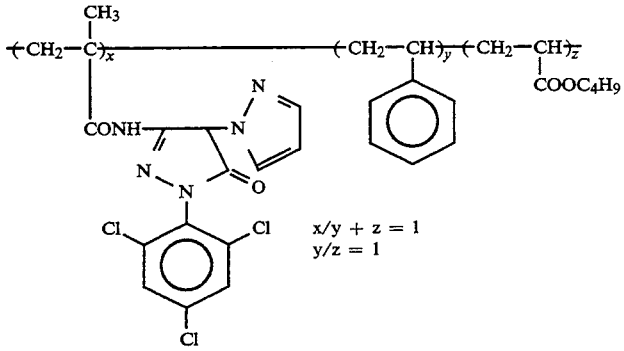
x/y + z = 1
y/z = 1
C-4

-continued
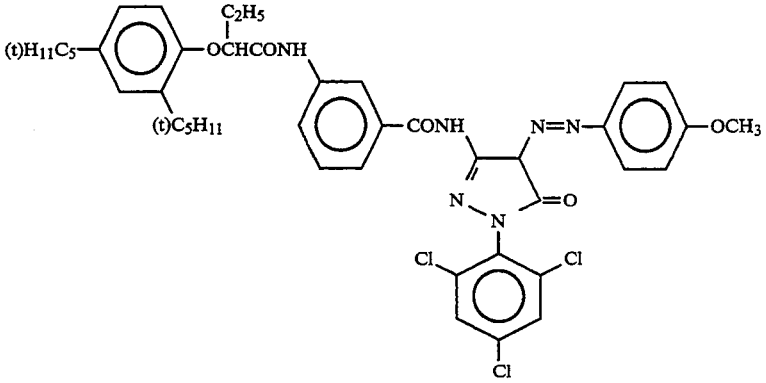
C-5
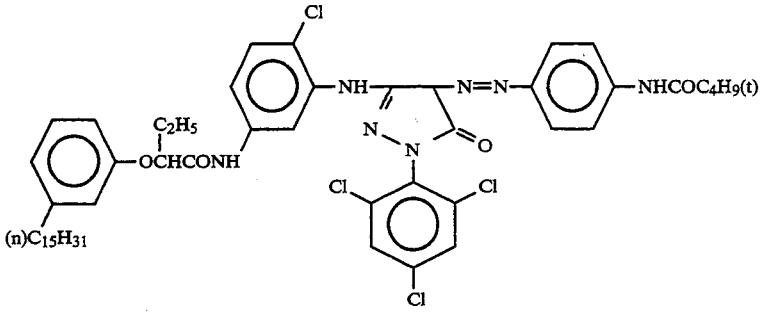
C-6
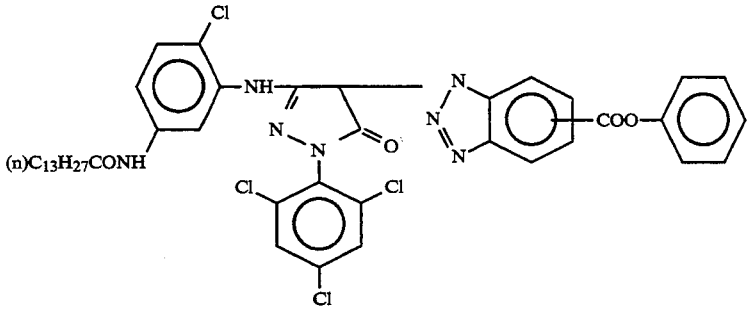
C-7
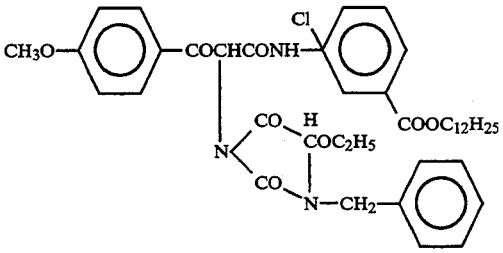
Cpd-1
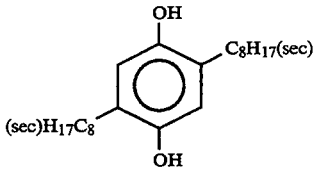
Cpd-2

-continued
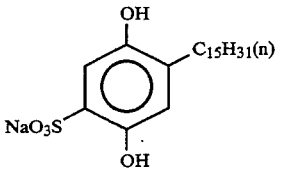
HBS-1
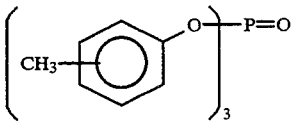
HBS-2
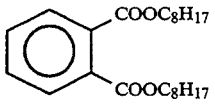
W-1
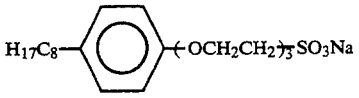
W-2
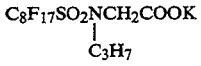
W-3
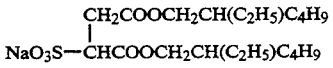
W-4
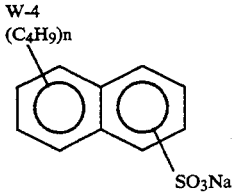
W-5
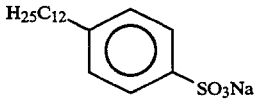
H-1
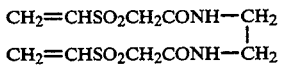
B-1
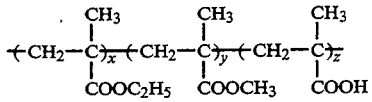
x/y/z = 4/4/2
B-2
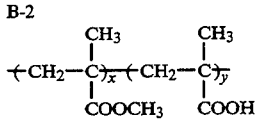
x/y = 9/1
B-3

-continued

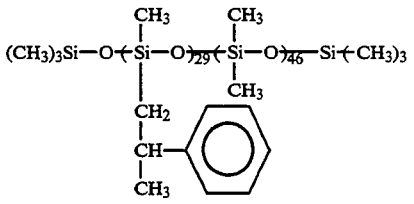

B-4

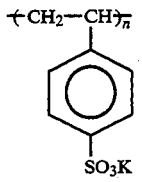

F-1

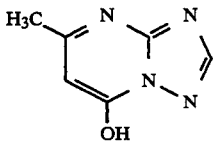

F-2

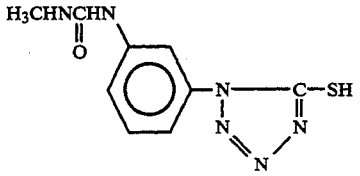

P-1

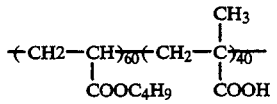

The numerals indicate a mole %

P-2

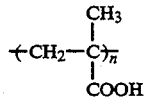

P-3

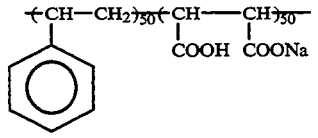

P-4

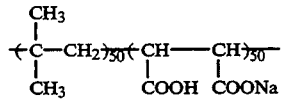

On each of the samples 101 to 119 thus obtained, an RMS pattern for graininess measurement was printed in, and each sample was subjected to the color development process, which well be explained later. The RMS of the magenta image of each sample was measured with specular (parallel) light. The results are summarized in Table 1. Further, each sample was cut into a piece having a width of 35 mm and a length of 10 m, and rolled on a plastic-made movie film spool having an outer diameter of 50 mm at a tension of 300 g. The roll was allowed to stand, first, in an atmosphere having a temperature of 25° C. and a relative humidity of 65% for 7 days, and then in an atmosphere having a temperature of 25° C. and a relative humidity of 10% for 48 hours. After that, each sample was rolled out at a rate of 50 cm/sec in the latter atmosphere, and was examined in terms of generation of static fog. Each sample rolled out was subjected to a developing process in the conditions listed below. From each developed 10 m-long sample, the mid 5 m-long portion was selected, and generation of static fog was examined by use of a magnifying glass. All of the static marks generated were as small as 2 mm or less, and the fog density was low.

The results were divided into ranking groups by the number of generation of fog, and listed in Table 1 as shown below.

| Rank | The number of static fogs/5 m |
|---|---|
| A | 0–3 |
| B | 4–10 |
| C | 11–20 |

| Steps | Developing process Temp. (°C.) | Time |
|---|---|---|
| Pre-bath | 27 ± 1 | 10″ |
| Removal of backing and rinsing | 27–38 | |
| Color development | 41.1 ± 0.1 | 3′00″ |
| Stop | 27–38 | 30″ |
| Acceleration | 27 ± 1 | 30″ |
| Bleaching with persulfate salt | 27 ± 1 | 3′00″ |
| Water washing | 27–38 | 1′00″ |
| Fixing | 38 ± 1 | 2′00″ |
| Water washing | 27–38 | 2′00″ |
| Final Rinsing | 27–38 | 10″ |
| Drying | 40–45 | 5′00″ |

| | |
|---|---|
| (Pre-bath) | |
| Water of 27–38° C. | 800 ml |
| Borax (decahydrate) | 20.0 g |
| Sodium sulfate | 100 g |
| Sodium hydroxide | 1.0 g |
| Water to make | 1 l |
| pH (27° C.) | 9.25 ± 0.1 |
| Specific gravity (27° C.) | 1.094 ± 0.004 |
| (Color Developing Solution) | |
| Water of 21–38° C. | 850 ml |
| Koddak anti-calcium No. 4 | 2.0 ml |
| Sodium sulfite (anhydous) | 2.0 g |
| Eastman anti-fog No. 9 | 0.22 g |
| Sodium bromide (anhydrous) | 1.20 g |
| Sodium carbonate (anhydrous) | 25.6 g |
| Sodium bicarbonate | 2.7 g |
| Coloring developing agent CD-3 | 4.0 g |

-continued

| | |
|---|---|
| Water to make | 1 l |
| pH (27° C.) | 10.2 ± 0.005 |
| Specific gravity (27° C.) | 1.029 ± 0.003 |
| (Stop bath) | |
| Water of 21–38° C. | 900 ml |
| 7.0N sulfuric acid | 50 ml |
| Water to make | 1 l |
| (Accelerating bath) | |
| Water of 24–38° C. | 900 ml |
| Sodium methabisulfite (anhydrous) | 10.0 g |
| Glacial acetic acid | 25.0 ml |
| Sodium acetate | 10 g |
| Tetrasodium ethylene-diaminetetraacetate (EDTA - 4Na) | 0.70 g |
| Koddak persulfite bleaching accelerator PBA-1 | 5.5 g |
| Water to make | 1 l |
| pH (27° C.) | 2.3 ± 0.2 |
| Specific gravity (27° C.) | 1.016 ± 0.003 |
| (Persulfate bleaching bath) | |
| Water of 24–38° C. | 800 ml |
| Gelatin | 0.5 g |
| Sodium persulfate | 33 g |
| Sodium chloride | 15 g |
| Sodium primary phosphate (anhydrous) | 9.0 g |
| Phosphoric acid (85%) | 2.5 ml |
| Water to make | 1 l |
| pH (27° C.) | 2.3 ± 0.2 |
| Specific gravity | 1.037 ± 0.03 |
| (Fixing bath) | |
| Water of 21–38° C. | 700 ml |
| Koddak anti-calcium No. 4 | 2.0 ml |
| 58% Aqueous solution of Ammonium thiosulfate | 185 ml |
| Sodium sulfite (anhydrous) | 10.0 g |
| Sodium bisulfite (anhydrous) | 8.4 g |
| Water to make | 1 l |
| pH (27° C.) | 6.5 ± 0.2 |
| Specific gravity (27° C.) | 1.086 ± 0.003 |
| (Final Rinsing bath) | |
| Water of 21–38° C. | 900 ml |
| Koddak stabilizer additive | 0.14 ml |
| Dearcide 702 | 0.7 ml |
| Water to make | 1 l |

TABLE 1

| Sample No. | | Layer 15 Matting agent x/y/z ratio | Acid polymer | Amount of acid polymer added* | Layer 14 UV absorbent | RMS (× $10^3$) | Ranking of static fog |
|---|---|---|---|---|---|---|---|
| 101 | (Comparative example) | 4/4/2 | — | — | — | 17 | B |
| 102 | (Comparative example) | 3.5/3.5/3 | — | — | — | 16 | B |
| 103 | (Comparative example) | 3/3/4 | — | — | — | 16 | B |
| 104 | (Comparative example) | 2.5/2.5/5 | — | — | — | 15 | B |
| 105 | (Comparative example) | 2/2/6 | — | — | — | 14 | C |
| 106 | (Comparative example) | 4/4/2 | P-1 | 25 | Exemplified compounds (6)-4 and (2)-5 in a weight ratio of 1:1 | 15 | A |
| 107 | (Present invention) | 3.5/3.5/3 | P-1 | 25 | Exemplified compounds (6)-4 and (2)-5 in a weight ratio of 1:1 | 10 | A |
| 108 | (Present invention) | 3/3/4 | P-1 | 25 | Exemplified compounds (6)-4 and (2)-5 in a weight ratio of 1:1 | 9 | A |
| 109 | (Present invention) | 2.5/2.5/5 | P-1 | 25 | Exemplified compounds (6)-4 | 8 | A |

TABLE 1-continued

| Sample No. | | Layer 15 Matting agent x/y/z ratio | Layer 15 Acid polymer | Layer 15 Amount of acid polymer added* | Layer 14 UV absorbent | RMS ($\times 10^3$) | Ranking of static fog |
|---|---|---|---|---|---|---|---|
| | | | | | and (2)-5 in a weight ratio of 1:1 | | |
| 110 | (Present invention) | 2/2/6 | P-1 | 25 | Exemplified compounds (6)-4 and (2)-5 in a weight ratio of 1:1 | 7 | A |
| 111 | (Comparative example) | 3/3/4 | P-1 | 25 | — | 9 | C |
| 112 | (Comparative example) | 2.5/2.5/5 | P-1 | 25 | — | 8 | C |
| 113 | (Present invention) | 0/6/4 | P-1 | 25 | Exemplified compounds (6)-4 and (2)-5 in a weight ratio of 1:1 | 9 | A |
| 114 | (Present invention) | 6/0/4 | P-1 | 25 | Exemplified compounds (6)-4 and (2)-5 in a weight ratio of 1:1 | 9 | A |
| 115 | (Present invention) | 3/3/4 | P-2 | 25 | Exemplified compounds (6)-4 and (2)-5 in a weight ratio of 1:1 | 10 | A |
| 116 | (Present invention) | 3/3/4 | P-3 | 25 | Exemplified compounds (6)-4 and (2)-5 in a weight ratio of 1:1 | 9 | A |
| 117 | (Present invention) | 3/3/4 | P-4 | 25 | Exemplified compounds (6)-4 and (2)-5 in a weight ratio of 1:1 | 8 | A |
| 118 | (Present invention) | 3/3/4 | P-1 | 4 | Exemplified compounds (6)-4 and (2)-5 in a weight ratio of 1:1 | 10 | A |
| 119 | (Present invention) | 3/3/4 | P-1 | 60 | Exemplified compounds (6)-4 and (2)-5 in a weight ratio of 1:1 | 7 | A |

*Weight percent of polymer to gelatin in layer 15

As is evident from Table 1, each of the samples 107 to 110, in which the acid polymer and the UV absorbent of the present invention were used, exhibited a remarkably improved graininess (RMS as measured with specular light) as compared to that of each of the comparative samples 102–105, in which the acid polymer and the UV absorbent of the invention were not used. Regarding the mole ratio among x, y, and z of the matting agent (B-1), the sample 106 having a matting agent composition of $(x+y)/z=8/2$, which falls out of the range defined by the present invention, did not achieve the improvement of the graininess, even if the acid polymer of the invention was used along with it. This is because the sample 106 has an alkali-solubility of the matting agent particles lower than those of the samples 107 to 110 each having a ratio of $(x+y)/z=7/3$.

As compared to comparative samples 103 and 104, in which the acid polymer and UV absorbent of the present invention were not used, the comparative samples 111 and 112, in which only the polymer of the present invention was used, exhibited a significantly improved graininess, but at the same time, a degraded static fog, which practically leaves a drawback behind. In contrast, the samples 108 and 109 of the invention, in each of which the UV absorbent is used in the layer 14, compensate completely for the degraded static fog. Each of the samples 113 and 114 of the present invention involves a variation in the composition of the matting agent, and each of the samples 115 to 117 involves a variation in the type of the acid polymer, and all of these samples exhibit the effect of the present invention. Each of the samples 118 and 119 of the present invention involves a variation in the weight ratio of the acid polymer with respect to the amount of gelatin in the layer 15, and both samples achieve the effect of the present invention.

EXAMPLE 2

A multi-layered color light-sensitive material was prepared by coating layers having the following compositions on an undercoated thriacetylcellulose film support, thereby obtaining a sample 201.

Numerals, each corresponding to each component, indicate an addition amount per $m^2$, and the amount of silver halide used is represented in terms of silver amount. As for the sensitizing dyes, the amount is expressed in mole per mole of silver halide in the indicated layer.

| | |
|---|---|
| **Layer 1: Anti-halation layer** | |
| Black colloidal silver | 0.91 |
| UV absorbent C-21 | 0.04 |
| UV absorbent C-22 | 0.18 |
| HBS-22 | 0.09 |
| Gelatin | 1.50 |
| **Layer 2: Intermediate layer** | |
| Compound H-21 | 0.30 |
| Coupler C-27 | 0.07 |
| HBS-21 | 0.11 |
| HBS-22 | 0.01 |
| Gelatin | 1.50 |
| **Layer 3: First red-sensitive emulsion layer** | |
| Silver bromoiodide emulsion (AgI content: 5 mol %, average grain size: 0.4 μm) | 0.50 |
| Sensitizing dye 2-I | $9.0 \times 10^{-5}$ |
| Sensitizing dye 2-II | $2.5 \times 10^{-5}$ |
| Sensitizing dye 2-III | $3.5 \times 10^{-4}$ |
| Sensitizing dye 2-IV | $2.5 \times 10^{-5}$ |
| Coupler C-23 | 0.26 |
| Coupler C-24 | 0.01 |
| Coupler C-25 | 0.01 |
| Gelatin | 1.60 |
| **Layer 4: Second red-sensitive emulsion layer** | |
| Silver bromoiodide emulsion (AgI content: 6 mol %, average grain size: 0.65 μm) | 1.15 |
| Sensitizing dye 2-I | $6.6 \times 10^{-5}$ |
| Sensitizing dye 2-II | $2.0 \times 10^{-5}$ |
| Sensitizing dye 2-III | $2.7 \times 10^{-4}$ |
| Sensitizing dye 2-IV | $1.8 \times 10^{-5}$ |
| Coupler C-32 | 0.06 |
| Coupler C-23 | 0.04 |
| Coupler C-33 | 0.01 |
| Coupler C-25 | 0.03 |
| HBS-21 | 0.12 |
| HBS-22 | 0.11 |
| Gelatin | 1.05 |
| **Layer 5: Third red-sensitive emulsion layer** | |
| Silver bromoiodide emulsion (AgI content: 10 mol %, average grain size: 0.75 μm) | 0.80 |
| Sensitizing dye 2-I | $7.0 \times 10^{-5}$ |
| Sensitizing dye 2-II | $2.0 \times 10^{-5}$ |
| Sensitizing dye 2-III | $2.8 \times 10^{-5}$ |
| Sensitizing dye 2-IV | $2.1 \times 10^{-5}$ |
| Coupler C-32 | 0.04 |
| Coupler C-23 | 0.03 |
| HBS-21 | 0.06 |
| HBS-22 | 0.05 |
| Gelatin | 0.65 |
| **Layer 6: Intermediate layer** | |
| Compound H-21 | 0.02 |
| Gelatin | 1.10 |
| **Layer 7: First green-sensitive emulsion layer** | |
| Silver bromoiodide emulsion (AgI content: 5 mol %, average grain size: 0.35 μm) | 1.34 |
| Sensitizing dye 2-V | $4.5 \times 10^{-4}$ |
| Sensitizing dye 2-VI | $4.0 \times 10^{-5}$ |
| Coupler C-26 | 0.29 |
| Coupler C-27 | 0.05 |
| Coupler C-28 | 0.08 |
| Coupler C-24 | 0.06 |
| HBS-21 | 0.31 |
| Gelatin | 1.20 |
| **Layer 8: Second green-sensitive emulsion layer** | |
| Silver bromoiodide emulsion (AgI content: 6 mol %, average grain size: 0.65 μm) | 0.55 |
| Sensitizing dye 2-V | $3.4 \times 10^{-4}$ |

-continued

| | |
|---|---|
| Sensitizing dye 2-VI | $2.5 \times 10^{-5}$ |
| Coupler C-26 | 0.03 |
| Coupler C-29 | 0.001 |
| Coupler C-28 | 0.001 |
| HBS-21 | 0.034 |
| Gelatin | 0.55 |
| **Layer 9: Third green-sensitive emulsion layer** | |
| Silver bromoiodide emulsion (AgI content: 10 mol %, average grain size: 0.8 μm) | 0.62 |
| Sensitizing dye 2-V | $3.8 \times 10^{-4}$ |
| Sensitizing dye 2-VI | $3.0 \times 10^{-5}$ |
| Coupler C-26 | 0.03 |
| Coupler C-28 | 0.001 |
| HBS-21 | 0.04 |
| Gelatin | 0.50 |
| **Layer 10: Yellow filter layer** | |
| Yellow colloidal silver | 0.040 |
| Compound H-21 | 0.10 |
| Coupler C-27 | 0.08 |
| HBS-21 | 0.09 |
| Gelatin | 0.80 |
| **Layer 11: First blue-sensitive emulsion layer** | |
| Silver bromoiodide emulsion (AgI content: 6 mol %, average grain size: 0.40 μm) | 0.30 |
| Coupler C-30 | 0.41 |
| Coupler C-34 | 0.03 |
| HBS-21 | 0.16 |
| Gelatin | 0.50 |
| **Layer 12: Second blue-sensitive emulsion layer** | |
| Silver bromoiodide emulsion (AgI content: 10 mol %, average grain size: 0.70 μm) | 0.45 |
| Sensitizing dye 2-VII | $3.0 \times 10^{-4}$ |
| Coupler C-30 | 0.05 |
| HBS-21 | 0.02 |
| Gelatin | 0.50 |
| **Layer 14: First protective layer** | |
| HBS-22 | 0.12 |
| Gelatin | 1.10 |
| **Layer 15: Second protective layer** | |
| B-1 (x/y/z = 4/4/2, average grain diameter: 2.0 μm) | 0.14 |
| B-2 | 0.01 |
| B-3 | 0.05 |
| Gelatin | 0.80 |

Each layer contained a gelatin hardener C-31 and a surfactant.

Samples 202 to 214 were prepared in a method similar to that of the Example 1 by use of compounds and in amounts of use listed in Table 2. The obtained samples 201 to 214 were subjected to a developing process, a graininess (RMS) test, and a static fog test, all similar to those of the Example 1, except that the relative humidity during the test for static fog was 20%. The rank of static fog in Example 2 was defined as below, and the results are summarized in Table 2.

| Rank | The number of static fogs/5 m |
|---|---|
| A | 0–3 |
| B | 4–10 |
| C | 11–20 |

The following are chemical formulas of the compounds used in Example 2.

-continued
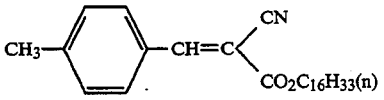
C-22
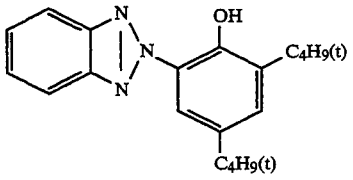
C-23
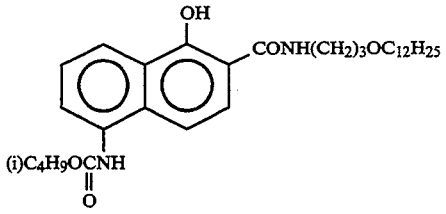
C-24
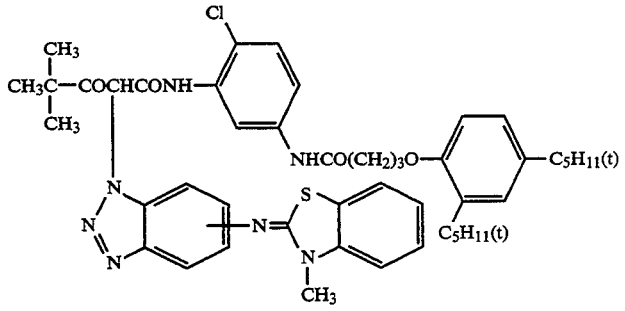
C-25
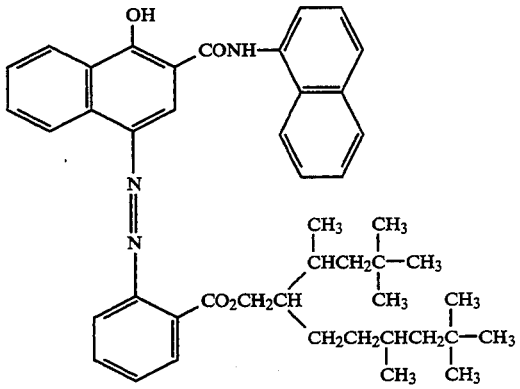
C-26

-continued
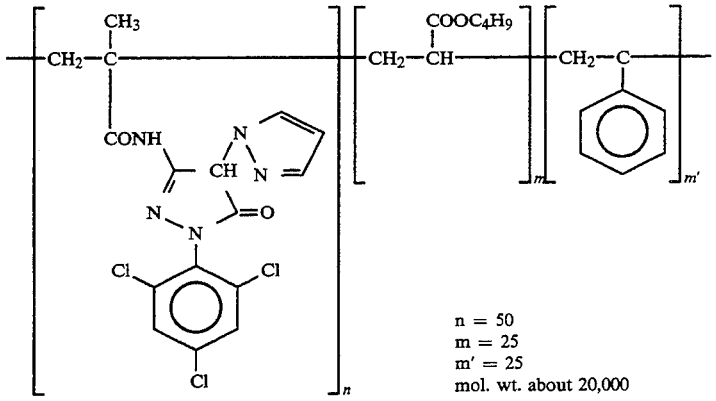
C-27
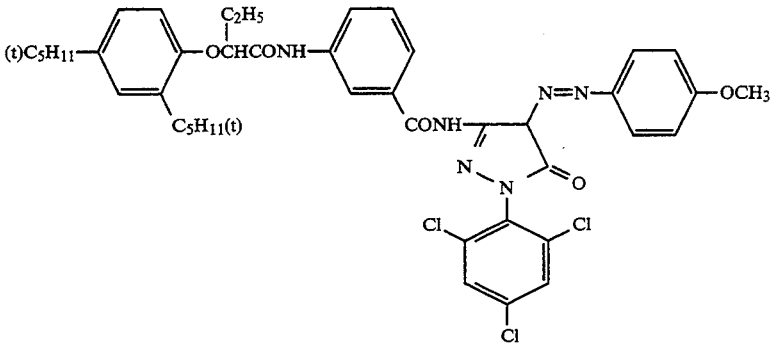
C-28
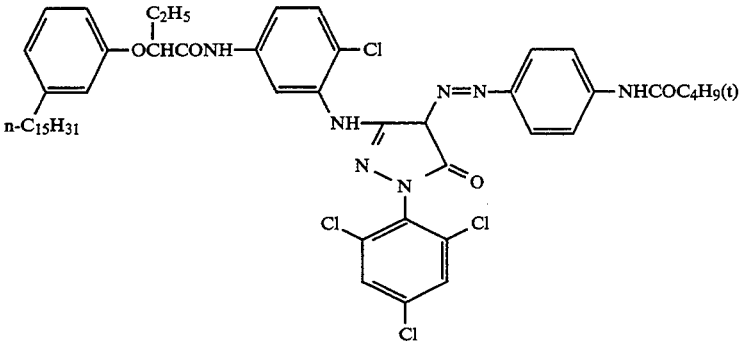
C-29
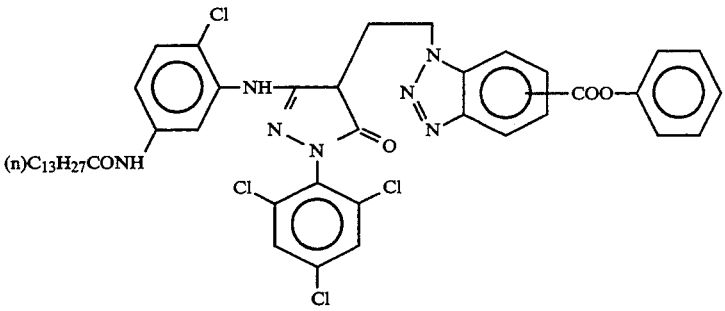
C-30

-continued
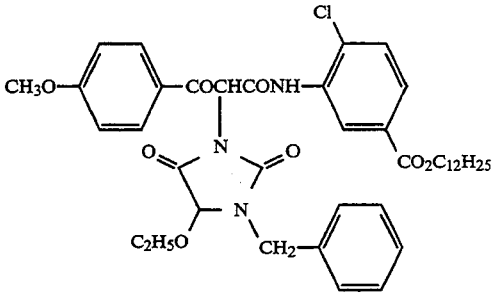
C-31
$(CH_2{=}CHSO_2CH_2CONHCH_2)_2$
C-32
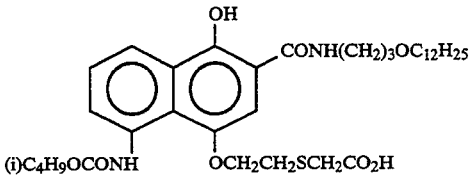
C-33
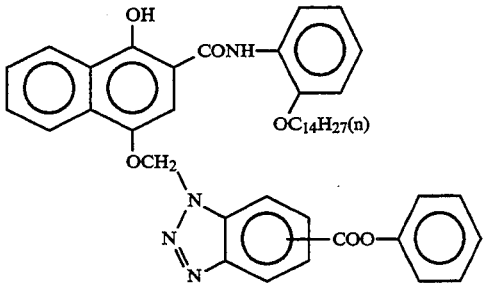
C-34
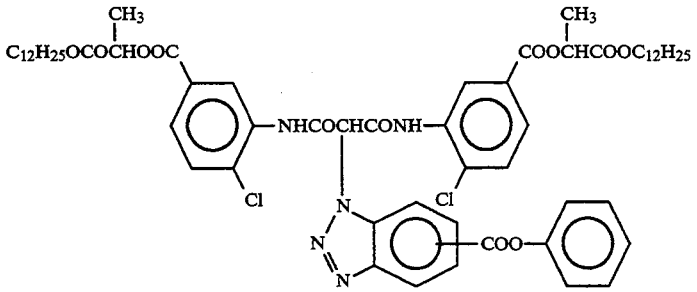
C-35
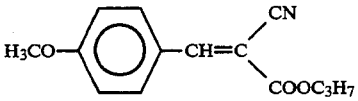
H-21
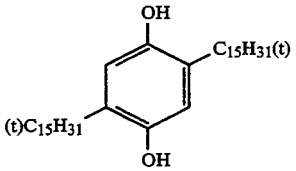
Sensitizing dye 2-I -continued
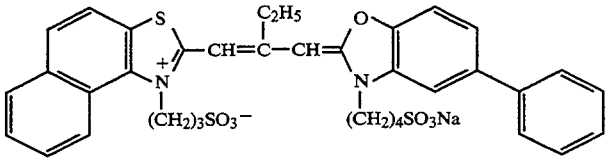
Sensitizing dye 2-II
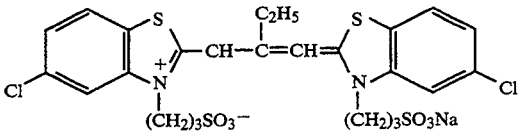
Sensitizing dye 2-III
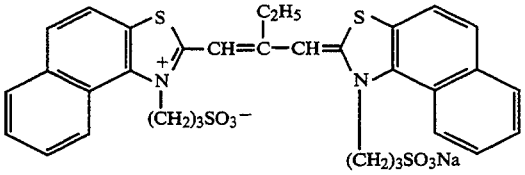
Sensitizing dye 2-IV
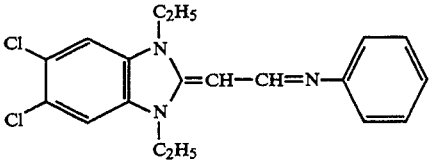
Sensitizing dye 2-V
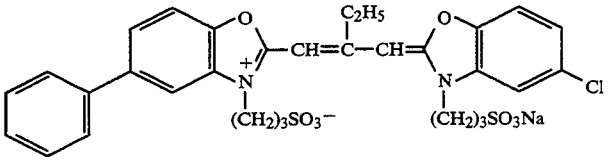
Sensitizing dye 2-VI
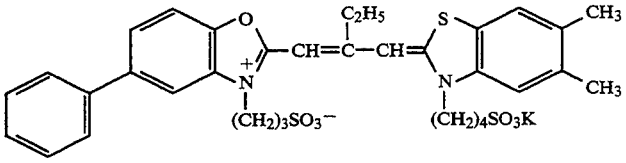
Sensitizing dye 2-VII
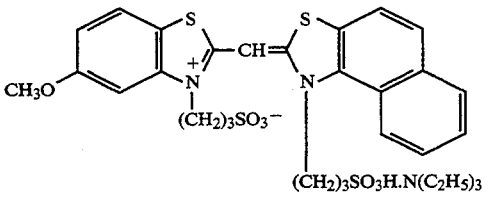
HBS-21
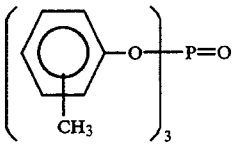
HBS-22

-continued

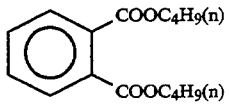

B-1

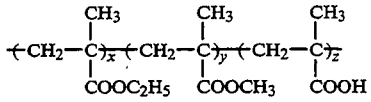

x/y/z = 4/4/2

B-2

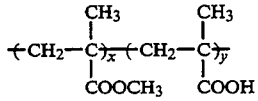

x/y = 9/1

B-3

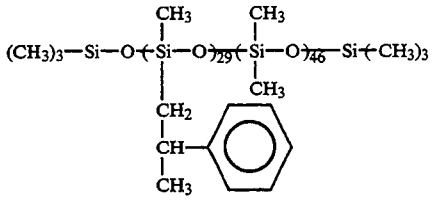

TABLE 2

| Sample No. | | Layer 15 Matting agent x/y/z ratio | Layer 15 Acid polymer | Layer 15 Amount of acid polymer added* | Layer 14 UV absorbent | RMS ($\times 10^3$) | Ranking of static fog |
|---|---|---|---|---|---|---|---|
| 201 | (Comparative example) | 4/4/2 | — | — | — | 24 | B |
| 202 | (Comparative example) | 3/3/4 | — | — | — | 23 | B |
| 203 | (Comparative example) | 2.5/2.5/5 | — | — | — | 21 | C |
| 204 | (Comparative example) | 4/4/2 | P-1 | 25 | — | 17 | C |
| 205 | (Comparative example) | 3/3/4 | P-1 | 25 | — | 17 | C |
| 206 | (Comparative example) | 2.5/2.5/5 | P-1 | 25 | | 16 | C |
| 207 | (Comparative example) | 4/4/2 | P-1 | 25 | Exemplified compounds (6)-4 and (2)-5 in a weight ratio of 1:1 | 17 | A |
| 208 | (Present invention) | 3/3/4 | P-1 | 25 | Exemplified compounds (6)-4 and (2)-5 in a weight ratio of 1:1 | 15 | A |
| 209 | (Present invention) | 2.5/2.5/5 | P-1 | 25 | Exemplified compounds (6)-4 and (2)-5 in a weight ratio of 1:1 | 15 | A |
| 210 | (Present invention) | 3/3/4 | P-2 | 25 | Exemplified compounds (6)-4 and (2)-5 in a weight ratio of 1:1 | 15 | A |
| 211 | (Present invention) | 3/3/4 | P-3 | 25 | Exemplified compounds (6)-4 and (2)-5 in a weight ratio of 1:1 | 14 | A |
| 212 | (Present invention) | 3/3/4 | P-4 | 25 | Exemplified compounds (6)-4 and (2)-5 in a weight ratio of 1:1 | 14 | A |
| 213 | (Present invention) | 3/3/4 | P-1 | 25 | Exemplified compounds (6)-3 | 15 | A |

TABLE 2-continued

| Sample No. | Layer 15 Matting agent x/y/z ratio | Layer 15 Acid polymer | Layer 15 Amount of acid polymer added* | Layer 14 UV absorbent | RMS ($\times 10^3$) | Ranking of static fog |
|---|---|---|---|---|---|---|
| | | | | and (3)-2 in a weight ratio of 1:1 | | |
| 214 (Present invention) | 3/3/4 | P-1 | 25 | Exemplified compounds (2)-11 and C-15 in a weight ratio of 1:1 | 15 | A |

*Weight percent of polymer to gelatin in layer 15

As is evident from Table 2, each of the samples 204 to 206, in which the acid polymer of the present invention was used, had a remarkably upgraded RMS value, measured by use of specular light source, indicating the improvement of graininess as compared to that of each of the comparative samples 201 to 203, in which the acid polymer was not used; however each of the samples 204 to 206 shows a degradation in terms of static fog, which makes the practical use of each sample difficult. In contrast, each of the samples 208 and 209 of the invention, in which the UV absorbent was used in the layer 14, had the complete recovery from the degraded static fog, and exhibited a remarkably improved RMS.

The comparative sample 207 having a mat agent composition of x/y/z=4/4/2, which fell out of the range defined by the present invention, did not achieve the object of the present invention as in the Example 1 since the solubility of the matting agent particles was low even if the acid polymer was used. Further, as in the Example 1, the samples 210 to 212 each of which used a different type of acid polymer which fell within the range of the compounds of the present invention, and the samples 213 and 214 each of which used a different type of UV absorbent which also fell within the range, achieved the effect of the present invention.

As described above, according to the present invention, there is provided a silver halide color light-sensitive material having an excellent graininess without being affected by matting agent particles, and an excellent anti-static fog property.

What is claimed is:

1. A silver halide color photographic light-sensitive material comprising at least one light-sensitive silver halide emulsion layer containing color couplers, and a protective layer comprising a non-light-sensitive hydrophillic colloid as the outermost layer, on a support, wherein the protective layer contains an acid polymer having at least one acidic group selected from a carboxyl group, a phosphoric acid group and a sulfonic acid group, and a matting agent comprising particles of a polymer represented by the following formula (1), and at least one protective layer contains an ultraviolet absorbent:

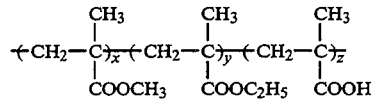

Formula (1)

where x, y, and z each represents a mole ratio, satisfying $3/7<(x+y)/z<7/3$.

2. The light-sensitive material according to claim 1, wherein said matting agent has a particle diameter of 1 to 5 $\mu$m.

3. The light-sensitive material according to claim 1, wherein said protective layer consists of 2 or more sublayers.

4. The light-sensitive material according to claim 1, which is in the form of a color negative film, or an intermediate film for movie.

5. The light-sensitive material according to claim 1, wherein the acid polymer forms a continuous phase in the protective layer.

* * * * *